US010644420B1

(12) United States Patent
Ishida

(10) Patent No.: US 10,644,420 B1
(45) Date of Patent: May 5, 2020

(54) ELECTRIC CONNECTOR AND ELECTRIC CONNECTOR SET

(71) Applicant: SMK Corporation, Tokyo (JP)

(72) Inventor: Yoshiyasu Ishida, Saitama (JP)

(73) Assignee: SMK Corporation, Tokyo (JP)

( * ) Notice: Subject to any disclaimer, the term of this patent is extended or adjusted under 35 U.S.C. 154(b) by 0 days.

(21) Appl. No.: 16/505,756

(22) Filed: Jul. 9, 2019

(30) Foreign Application Priority Data

Oct. 11, 2018 (JP) ..... 2018-192398

(51) Int. Cl.
*H01R 12/70* (2011.01)
*H01R 12/71* (2011.01)

(52) U.S. Cl.
CPC ..... *H01R 12/7052* (2013.01); *H01R 12/712* (2013.01)

(58) Field of Classification Search
CPC ..... H01R 12/16; H01R 12/17; H01R 12/18; H01R 12/7029; H01R 12/716; H01R 12/627
See application file for complete search history.

(56) References Cited

U.S. PATENT DOCUMENTS 5,545,051 A * 8/1996 Summers ..... H01R 12/716 439/350
5,626,482 A * 5/1997 Chan ..... H01R 12/716 439/74
6,116,949 A * 9/2000 Costello ..... H01R 13/6485 439/509
6,855,004 B2 * 2/2005 Soh ..... H01L 23/60 439/41
6,955,546 B1 * 10/2005 Huang ..... H01R 13/5213 439/135
7,074,085 B2 * 7/2006 Chen ..... H01R 13/658 439/607.36
7,232,317 B2 * 6/2007 Ookura ..... H01R 13/506 439/660
7,367,816 B2 * 5/2008 Liu ..... H01R 13/26 439/74
7,748,994 B1 * 7/2010 Peng ..... H01R 12/716 439/660

(Continued)

FOREIGN PATENT DOCUMENTS

JP 5972855 B2 * 8/2016 ..... H01R 12/7052

*Primary Examiner* — Nader J Alhawamdeh

(57) ABSTRACT

The electric connector includes: a connector housing having a depressed fitting portion, the connector housing being able to be protrusion-depression engaged with a connector housing of a counterpart connector in an opposed direction; a plurality of connection terminal rows provided in the connector housing; and a conductive member having conductive first plates attached to the connector housing on both outsides of the connection terminal rows in a row direction of the connection terminals. The connector housing has a terminal holder that is provided in a protruding manner in the depressed fitting portion, and holds one ends of the connection terminals in a row width direction. The conductive member has a second plate that extends from an end portion of the first plate on the side of the terminal holder to the inside of the terminal holder in the row direction of the connection terminals.

9 Claims, 26 Drawing Sheets

(56) References Cited

U.S. PATENT DOCUMENTS

| | | | | |
|---|---|---|---|---|
| 7,922,499 | B2 * | 4/2011 | Liao | H01R 12/714 439/660 |
| 8,272,881 | B2 * | 9/2012 | Miyazaki | H01R 12/716 439/345 |
| 8,292,635 | B2 * | 10/2012 | Little | H01R 12/7029 439/570 |
| 8,992,233 | B2 * | 3/2015 | Miyazaki | H01R 12/707 439/74 |
| 2004/0018756 | A1 * | 1/2004 | Pan | H01R 13/6271 439/74 |
| 2010/0130068 | A1 * | 5/2010 | Peng | H01R 13/2457 439/660 |
| 2010/0190383 | A1 * | 7/2010 | Yamada | H01R 13/6315 439/680 |
| 2011/0165797 | A1 * | 7/2011 | Takeuchi | H01R 12/716 439/660 |
| 2011/0250800 | A1 * | 10/2011 | Guo | H01R 12/716 439/660 |
| 2013/0012074 | A1 * | 1/2013 | Mashiyama | H01R 12/73 439/660 |
| 2013/0023162 | A1 * | 1/2013 | Harlan | H01R 12/73 439/660 |
| 2013/0280926 | A1 * | 10/2013 | Ono | H01R 12/712 439/65 |
| 2014/0227910 | A1 * | 8/2014 | Tanaka | H01R 12/7052 439/626 |
| 2015/0207248 | A1 * | 7/2015 | Takenaga | H01R 12/716 439/74 |

* cited by examiner

ELECTRIC CONNECTOR AND ELECTRIC CONNECTOR SET

CROSS REFERENCE TO RELATED APPLICATION

The contents of the following Japanese patent application are incorporated herein by reference, Japanese Patent Application No. 2018-192398 filed on Oct. 11, 2018.

FIELD

The present invention relates to an electric connector and an electric connector set, and in particular, to a socket or plug type electric connector that is mounted on a circuit substrate and is protrusion-depression fit into a counterpart electric connector, and an electric connector set including a socket and a plug.

BACKGROUND

Flat plate-shaped electric connectors mounted on substrates are conventionally used as connectors for connecting flexible circuit substrates to circuit substrates, and the like.

As this type of electric connectors, for example, there is known a connector having a structure such that a first connector and a second connector can be fit in a state opposed to each other using a first fitting guide and a second fitting guide provided in the first and second connectors, respectively, and a contact arm of a first reinforcing metal piece mounted on the first connector and a contact arm of a second reinforcing metal piece mounted on the second connector have an increased contact area (see, for example, Patent Literature 1).

In the electric connector described in Patent Literature 1, the fitting between the first connector and the second connector provides continuity between the first reinforcing metal piece and the second reinforcing metal piece, and hence provides electric connection between a power line of a first substrate on which the first connector is mounted and a power line of a second substrate on which the second connector is mounted.

CITATION LIST

Patent Literature

Patent Literature 1: Japanese Patent Application Laid-Open No 2013-101909.

SUMMARY

Technical Problem

However, in the electric connector described in Patent Literature 1, the contact area between the contact arm of the first reinforcing metal piece and the contact arm of the second reinforcing metal piece is small. For example, when the first and second reinforcing metal pieces are used as power terminals, supplying a large current from a power supply cannot help generating heat at the terminal portions to a high temperature state. Therefore, it is difficult to allow a large current to flow through the electric connector described in Patent Literature 1, while preventing an increase in temperature at the terminal portions.

Some of this type of electric connectors have spring members for holding connection terminals of connection terminal rows. In this type of conventional electric connector, when connection terminal portions, which constitute conductive paths for conducting electricity, are heated too high, the spring members that are elastically deformed during fitting tend to be plastically deformed. Since the occurrence of plastic deformation of the spring members causes a reduction in a contact load, stable electric connection cannot be established, thus causing the occurrence of a contact failure (operation failure).

As described above, the conventional electric connector has problems that the contact area of the terminal portions constituting the conductive paths is small, it is difficult to supply a large current in a state of suppressing heat generation at the terminal portions, and the plastic deformation of peripheral portions caused by the influence of the heat generation at the terminal portions makes electric connection unstable.

In view of the above, it is an object of the present invention to provide an electric connector that allows supply of a large current while preventing heat generation at terminal portions, and that allows stabilization of electric connection, and an electric connector set.

Solution to Problem

In order to achieve the aforementioned object, an electric connector of an aspect of the present invention includes: a connector housing having a depressed fitting portion, the connector housing being able to be protrusion-depression engaged with a connector housing of a counterpart connector having a protruding fitting portion in an opposed direction; a plurality of connection terminal rows arranged approximately in the same plane in the connector housing; and a conductive member having conductive first plates attached to the connector housing on both outsides of the connection terminal rows in a row direction of the connection terminals. The connector housing has a terminal holder that is provided in a protruding manner in the depressed fitting portion at a position opposite a middle depressed portion of the protruding fitting portion, and holds one ends of the connection terminals in a row width direction. The conductive member has a second plate that extends from an end portion of the first plate on the side of the terminal holder to the inside of the terminal holder in the row direction of the connection terminals.

According to the configuration, in the electric connector according to the aspect of the present invention, the conductive member has the second plate that extends from the first plate to the inside of the terminal holder in the row direction of the connection terminals of the connection terminal rows, so that the conductive member can have an increased surface area (volume). Therefore, in the electric connector according to the aspect of the present invention, when the conductive member is used as a terminal constituting a conductive path, the temperature of terminal portions is less likely to increase during energization, and therefore it is possible to supply a larger current while an increase in the temperature of the terminal portions is suppressed. By suppressing an increase in the temperature of the terminal portions, the plastic deformation of peripheral portions due to the heat generation at the terminal portions can be reduced, thus allowing electric connection to be stabilized.

According to the electric connector of the aspect of the present invention, since the second plate of the conductive member extends to the inside of the terminal holder, it is possible to increase a stiffness at an outside portion of the connector housing against a load applied from the counterpart electric connector to the inside, and increase a stiffness at a portion extending inside the connector housing against a load applied from the counterpart electric connector to the inside, thus preventing a break by the loads when the counterpart electric connector is fit thereinto.

In the electric connector according to the aspect of the present invention, the conductive member may be configured such that the second plate extends to a position between the connection terminal rows in the terminal holder. With such a configuration, the conductive member of the electric connector according to the aspect of the present invention has an increased strength as the terminal, and allows maintaining stable electric connection even during the protrusion-depression engagement of the counterpart electric connector.

In the electric connector according to the aspect of the present invention, the conductive member may have a joint plate configured to join the first plate and the second plate, and the joint plate may intersect a plate surface of the first plate and a plate surface of the second plate.

With such a configuration, the electric connector of the aspect of the present invention can secure a high stiffness so as to be resistant to deformation against forces applied from different directions to the plate surface of the first plate and the plate surface of the second plate intersecting the plate surface, when the counterpart electric connector is fitted into, or removed from, the electric connector. Due to the improved stiffness, the electric connector is less likely to break by the forces applied when the counterpart electric connector is fitted into, or removed from, the electric connector, and has stable electric connection.

According to the electric connector of the aspect of the present invention, the conductive member may be configured such that the second plate is composed of a plate member having a plate surface parallel with a protrusion-depression engagement direction. With such a configuration, since the electric connector of the aspect of the present invention has an increased strength against a force in a direction orthogonal to the plate surface of the second plate, in other words, in the row width direction of the connection terminal rows, it can be expected that the electric connector has a heat generation inhibiting effect and an electric connection stabilizing effect, due to the extension of the second plate, while ensuring the strength of the conductive member as the terminal.

In the electric connector according to the aspect of the present invention, the conductive member may be configured such that the second plate is composed of a plate member having a plate surface perpendicular to the protrusion-depression engagement direction.

With such a configuration, since the electric connector of the aspect of the present invention has an increased strength against a force in the direction orthogonal to the plate surface of the second plate, in other words, a force in the protrusion-depression engagement direction, it can be expected that the electric connector has a heat generation inhibiting effect and an electric connection stabilizing effect, due to the extension of the second plate, while ensuring the strength of the conductive member as the terminal.

According to the electric connector of the aspect of the present invention, in the conductive member, the second plate may be composed of bent plate members that are provided at predetermined intervals along the row direction, and each of the bent plate members may be bent at both sides in the row width direction so as to have an opening engaged with an engagement protruding portion of the terminal holder.

With such a configuration, in the electric connector of the aspect of the present invention, the terminal has an increased volume by the provision of the bent plate members, so that it is possible to suppress heat generation and stabilize electric connection. Engaging the openings of the bent plate members with the engagement protruding portion of the terminal holder allows fixing the conductive member more firmly.

In the electric connector according to the aspect of the present invention, the conductive member may be configured such that the second plate is composed of bent plate members that are provided at predetermined intervals along the row direction, and the bent plate members are bent alternately to one side of the row width direction so as to form a surface that is engaged with an engagement portion of the terminal holder.

With such a configuration, in the electric connector of the aspect of the present invention, the terminal has an increased volume by the provision of the bent plate members, so that it is possible to suppress heat generation and stabilize electric connection. Engaging the surface, produced by alternately bending the bent plate members, with the engagement portion of the terminal holder allows fixing the conductive member more firmly.

In the electric connector according to the aspect of the present invention, the conductive member may be configured such that the second plate is composed of a gutter member having a groove portion along the row direction.

With such a configuration, in the electric connector of the aspect of the present invention, the terminal has an increased volume by the provision of the gutter member, so that it is possible to suppress heat generation and stabilize electric connection. Engaging the engagement protruding portion of the terminal holder with the groove portion of the gutter member allows fixing the conductive member more firmly.

In the electric connector according to the aspect of the present invention, the conductive member may be configured such that a part of the second plate is exposed on the side of a top surface of the terminal holder. With such a configuration, the electric connector of the aspect of the present invention facilitates assembling the connector housing containing the conductive member, as compared with the case of embedding the second plate in the terminal holder so as not to be exposed outside.

In the electric connector according to the aspect of the present invention, the conductive members may be configured such that the second plate extending from one first plate, out of the first plates attached to the connector housing on both outsides, and the second plate extending from the other first plate may be conductively coupled to each other.

With such a configuration, in the electric connector of the aspect of the present invention, the single conductive member can be operated as a signal line for sending various types of signals, in a protrusion-depression engaged state with the counterpart electric connector. Also in this case, since the conductive members are configured such that the second plates extend from the first plates on both ends to the inside of the terminal holder, it is possible to increase the volume of the conductive members as the signal terminal of the conductive member, and allow a large current to flow therethrough, while heat generation is suppressed.

To achieve the above-described objects, an electric connector set according to an aspect of the present invention includes the electric connector of the aspect of the present invention having any of the above-described configurations, and the counterpart connector.

With such a configuration of the electric connector set of the aspect of the present invention, in the electric connector that is protrusion-depression engaged with the counterpart connector, since the conductive member has the second plate that extends from the first plates to the inside of the terminal holder in the row direction of the connection terminals of the connection terminal rows, the conductive member has an increased volume (surface area). Therefore, in the electric connector set according to the aspect of the present invention, when the conductive member is used as a terminal constituting a conductive path, the temperature of terminal portions is less likely to increase during energization, and therefore it is possible to supply a larger current, while an increase in the temperature of the terminal portions is suppressed. In the electric connector set, by suppressing an increase in the temperature of the terminal portions on the side of the electric connector with which the counterpart connector is protrusion-depression engaged, the plastic deformation of peripheral portions due to the heat generation at the terminal portions can be reduced, thus allowing stabilizing electric connection.

Furthermore, in the electric connector set of the aspect of the present invention, since the second plate of the conductive member extends to the inside of the terminal holder, it is possible to increase a stiffness at an outside portion of the connector housing against a load applied from the counterpart electric connector to the inside, and increase a stiffness at a portion extending inside the connector housing against a load applied from the counterpart electric connector to the inside, thus preventing a break by the loads when the counterpart electric connector is engaged therewith.

According to the aspects of the present invention, it is possible to provide an electric connector that allows supply of a large current, while preventing heat generation at terminal portions, and that allows stabilization of electric connection, and an electric connector set.

DESCRIPTION OF EMBODIMENTS

Embodiments of the present invention will be described below with reference to the drawings.

First Embodiment

FIGS. 1 to 11B show an electric connector according to a first embodiment of the present invention.

Mainly taking a socket-side electric connector 20A as an example, a configuration thereof will be described below, but the present invention can also be applied to a plug-side electric connector 30A.

As shown in FIGS. 1 to 3B, an electric connector set 10 according to the present embodiment has a socket-shaped electric connector 20A and a plug-shaped electric connector 30A that are protrusion-depression engaged with each other in an opposed direction.

A connector body 20 of the electric connector 20A includes a connector housing 21 that is composed of a synthetic resin by injection molding so as to be mainly depressed on the side of a top surface and approximately flat on the side of a bottom surface, and conductive members 25A (see FIGS. 6A and 6B) that have portions (first plates 26) provided outside a plurality of male or female, e.g. female connection terminal rows 22*a* and 22*b* arranged approximately in the same plane (in a coplanar fashion) in the connector housing 21 in a row direction of the connection terminals and portions (second plates 27*a*) provided between the connection terminal rows 22*a* and 22*b*.

As shown in FIGS. 1 to 4B, the connector housing 21 includes a depressed fitting portion 21*a* in the shape of, for example, a rectangular ring-shaped groove, an external surface 21*b* extending along the depressed fitting portion 21*a*, a substrate facing surface 21*c* (see FIG. 3B)) that faces a circuit substrate P (see FIG. 2), and a terminal holder 21*j* having a plurality of rows of terminal holding portions 21*h* and 21*i* arranged along the groove shape of the depressed fitting portion 21*a*.

Figure 1:
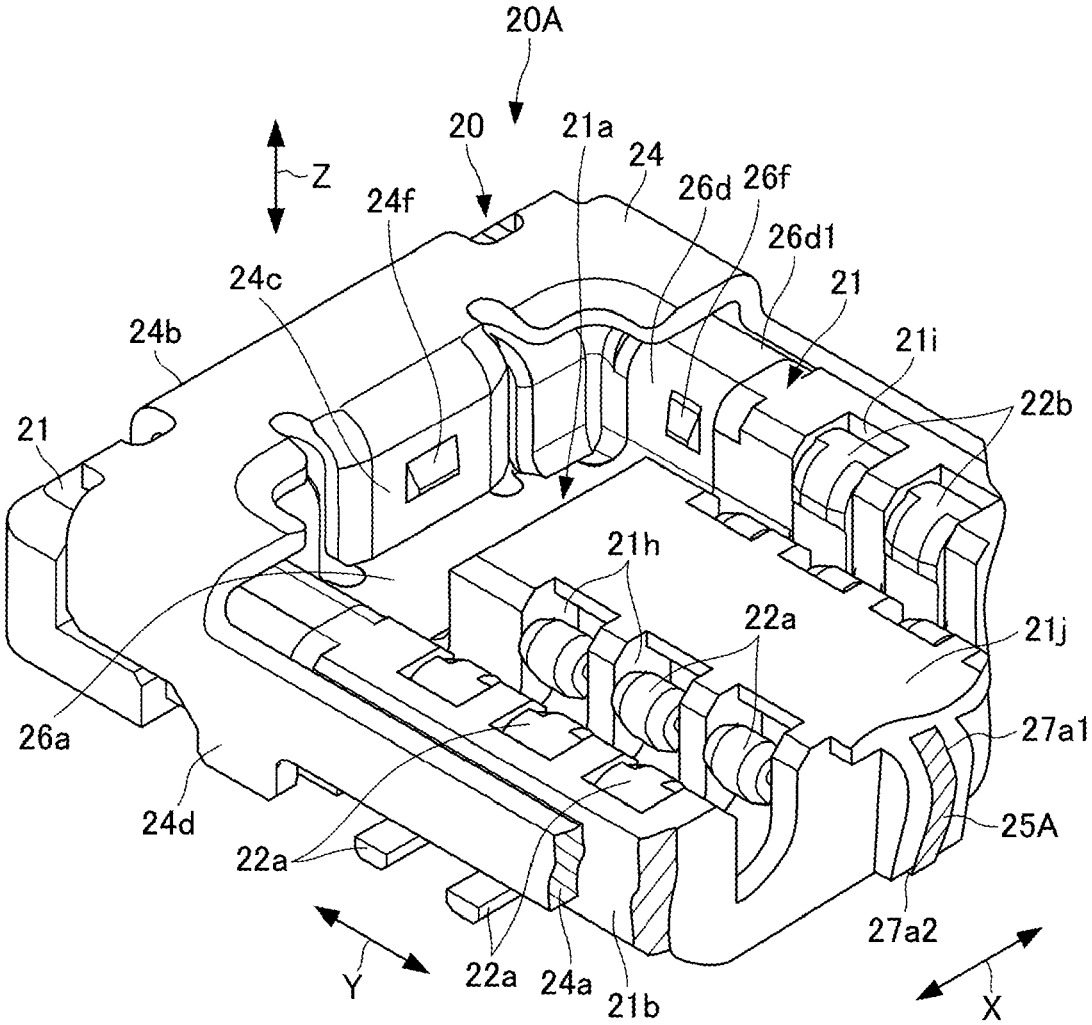
FIG. 1 is a perspective view, including a partly broken cross-sectional view, of a portion of an electric connector (socket) according to a first embodiment of the present invention.
Figure 2:
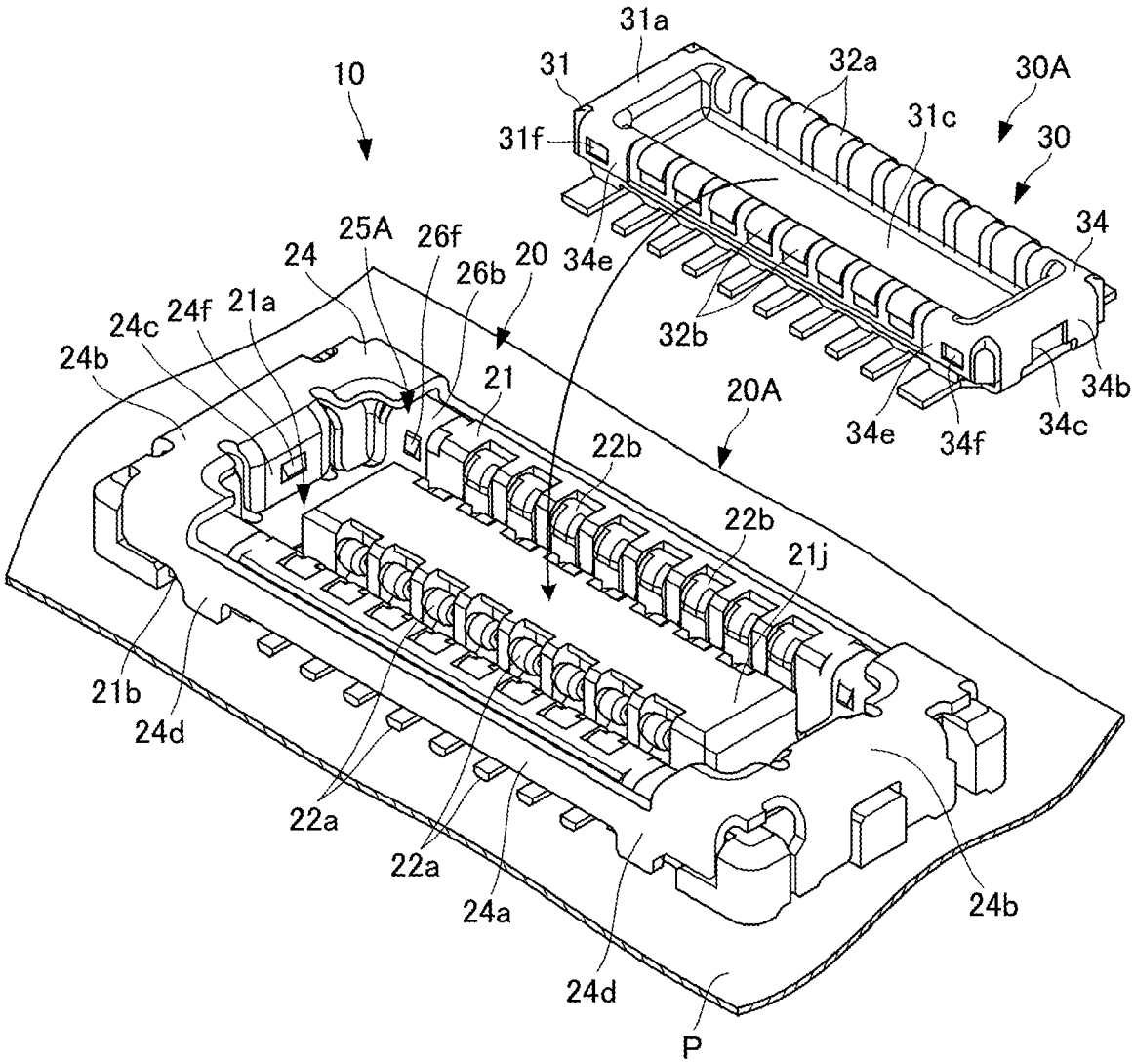
FIG. 2 is an exploded perspective view of an electric connector set according to the first embodiment of the present invention.

The connection terminal rows 22*a* and 22*b* function as receptacle contacts that are fitted into the terminal holding portions 21*h* and 21*i* of the connector housing 21, in which an X direction in FIG. 1 is defined as a row width direction. Each of the receptacle contacts is retained and held in the connector housing 21.

As illustrated in FIGS. 2 to 5B, a connector body 30 of the counterpart electric connector 30A includes a connector housing 31 mainly having a protruding shape on one surface, and a plurality of the other type of female and male, for example, male connection terminal rows 32*a* and 32*b* that are arranged in the connector housing 31 in a coplanar fashion.

The connector housing 31 includes a protruding fitting portion 31*a* in the shape of, for example, a rectangular ring-shaped projection, an external surface 31*b* (refer to FIG. 5A) extending along the protruding fitting portion 31*a*, and a middle depressed portion 31*c* situated inside the protruding fitting portion 31*a*.

The connection terminal rows 32*a* and 32*b* are plug contacts that are integrally attached to the protruding fitting portions 31*a* of the connector housing 31. Outer edges of the connection terminal rows 32*a* and 32*b* are arranged in parallel with each other.

The connector bodies 20 and 30 of the electric connector 20A and the counterpart electric connector 30A are provided with conductive reinforcing metal pieces 24 and 34, respectively.

As shown in FIGS. 1 to 4B and 8, the connector body 20 of the electric connector 20A has the conductive reinforcing metal piece 24 provided to be fit to the corresponding connector housing 21 from outside. The reinforcing metal piece 24 is composed of a sheet metal into a predetermined shape by pressing. The reinforcing metal piece 24 has a pair of long side plate portions 24*a* extending along the external surface 21*b* of the connector housing 21 on both sides in a lateral direction, a pair of connection plate portions 24*b* extending along the external surface 21*b* of the connector housing 21 on the outside of the depressed fitting portion 21*a* of the connector housing 21, pairs of internal and external edge plate portions 24*c* that are bent from the pair of connection plate portions 24*b* so as to protrude to the side of an inner depth (downward) of the depressed fitting portion 21*a*, and pairs of bent joint portions 24*d* that are joined to the pair of long side plate portions 24*a* and the pair of connection plate portions 24*b* at both ends and have bent shapes bent in the middle.

In the reinforcing metal piece 24, the pairs of internal and external edge plate portions 24*c* are provided with engagement protruding portions 24*f* that are engaged with stepped depressed portions 34*c* of the electric connector 30A, when the counterpart electric connector 30A is protrusion-depression engaged with the electric connector 20A.

The reinforcing metal piece 24 is attached to the connector housing 21 such that the pairs of internal and external edge plate portions 24*c* are overlaid on at least part of reinforcing metal piece joint portions of the conductive members 25A at both ends of the connector housing 21 in a longitudinal direction (see FIGS. 9A to 11B). Note that, the conductive member 25A includes the first plate 26 having side end plates 26*b*, 26*c*, and 26*d* (see FIGS. 6A and 6B) as the reinforcing metal piece joint portions, though the configuration thereof will be described later in detail with reference to FIGS. 6A and 6B. Furthermore, the conductive member 25A has a plurality of approximately protruding external joint portions 26*a*1 and 27*a*2 (see FIG. 3B) that are exposed to the side of the substrate facing surface 21*c* of the corresponding connector housing 21 of the connector body 20. Therefore, the reinforcing metal piece 24 is mechanically and electrically joined to the conductive members 25A, and due to connection to a predetermined conductive pattern of the circuit substrate P through the conductive members 25A, the reinforcing metal piece 24 can be electrically conductive through the conductive pattern.

Pairs of bottom ends of the pair of edge plate portions 24*c* and bottom ends of the pairs of bent joint portions 24*d* of the reinforcing metal piece 24 are disposed approximately in the same plane with bottom surfaces of the connection terminal rows 22*a* and 22*b* and bottom surfaces of the external joint portions 26*a*1 and 27*a*2 (see FIGS. 3B and 4B) of the conductive members 25A of the connector housing 21, or are set at a predetermined protrusion height.

Figure 5A:
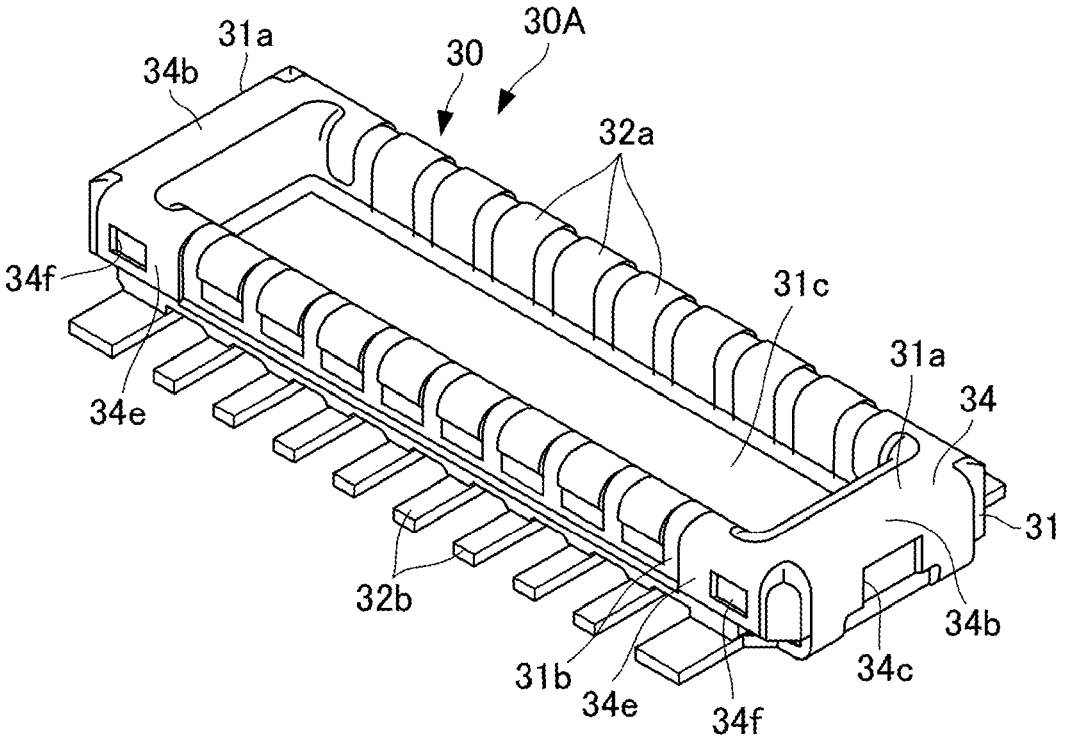
FIG. 5A is an exterior perspective view of the electric connector (plug) according to the first embodiment of the present invention, showing its exterior on a bottom side having a convex shape.
Figure 5B:
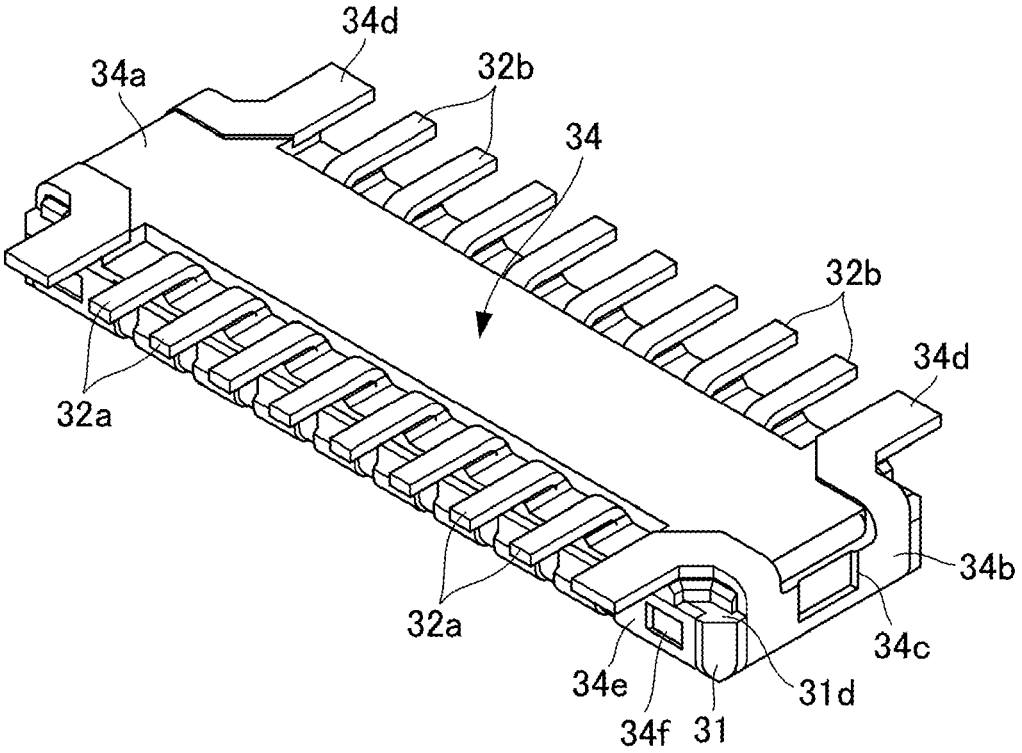
FIG. 5B is an exterior perspective view of the electric connector (plug) according to the first embodiment of the present invention, showing its exterior on a top side.

As shown in FIGS. 5A and 5B, the reinforcing metal piece 34 provided in the connector body 30 of the counterpart electric connector 30A has a top cover 34*a* (see FIG. 5B) extending throughout a top surface 31*d* of the connector housing 31 in the longitudinal direction, both edge plate portions 34*b* that cover both end surfaces of the connector housing 31 in the longitudinal direction and bottom surfaces in the vicinities thereof, the stepped depressed portions 34*c* formed in parts of both the edge plate portions 34*b*, the pairs of attachment handles 34*d* extending from both the edge plate portions 34*b* to the top surface of the connector housing 31, and pairs of side plate portions 34*e* that extend from both the edge plate portions 34*b* to both the side surfaces of the connector housing 31. Of these, in each pair of side plate portions 34*e*, engagement depressed portions 34*f* with which engagement protruding portions 26*f* (see FIGS. 6A and 6B) provided in the conductive member 25A are engaged, when being protrusion-depression engaged with the electric connector 20A, to maintain the engagement are formed.

Figure 6A:
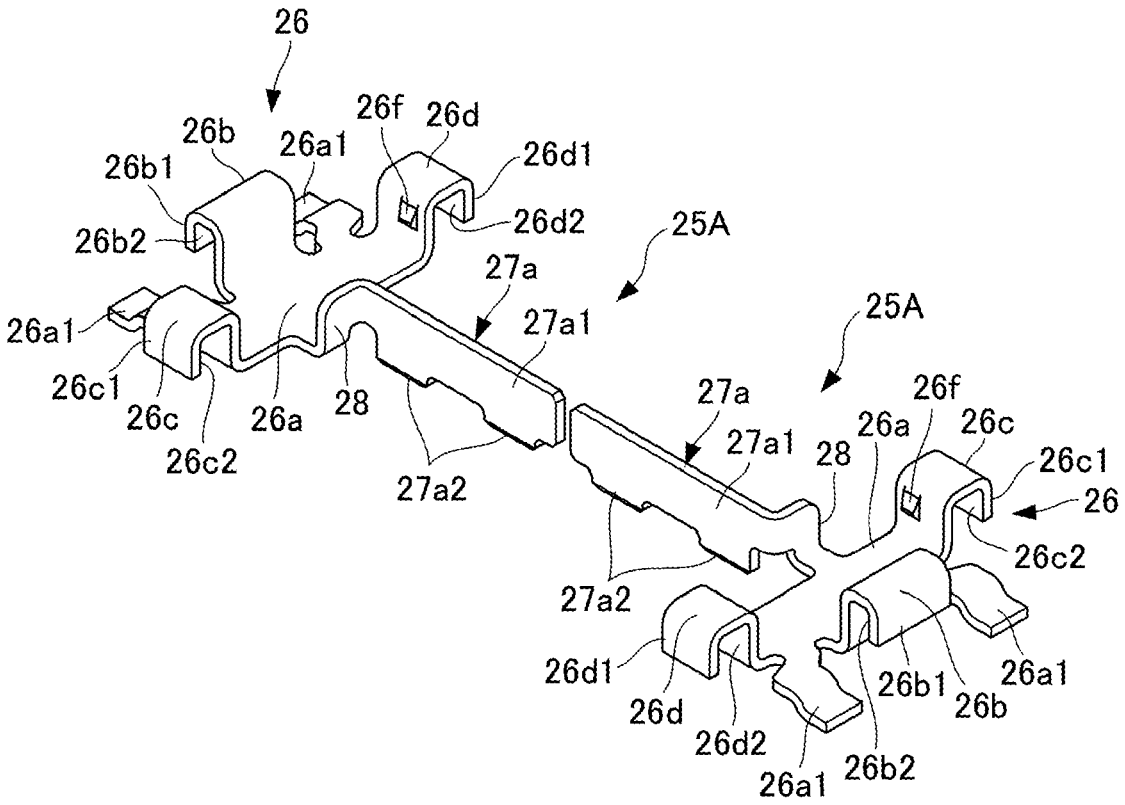
FIG. 6A is a perspective view of conductive members attached to a connector housing of the electric connector (socket) according to the first embodiment of the present invention, showing its exterior on a top side.
Figure 6B:
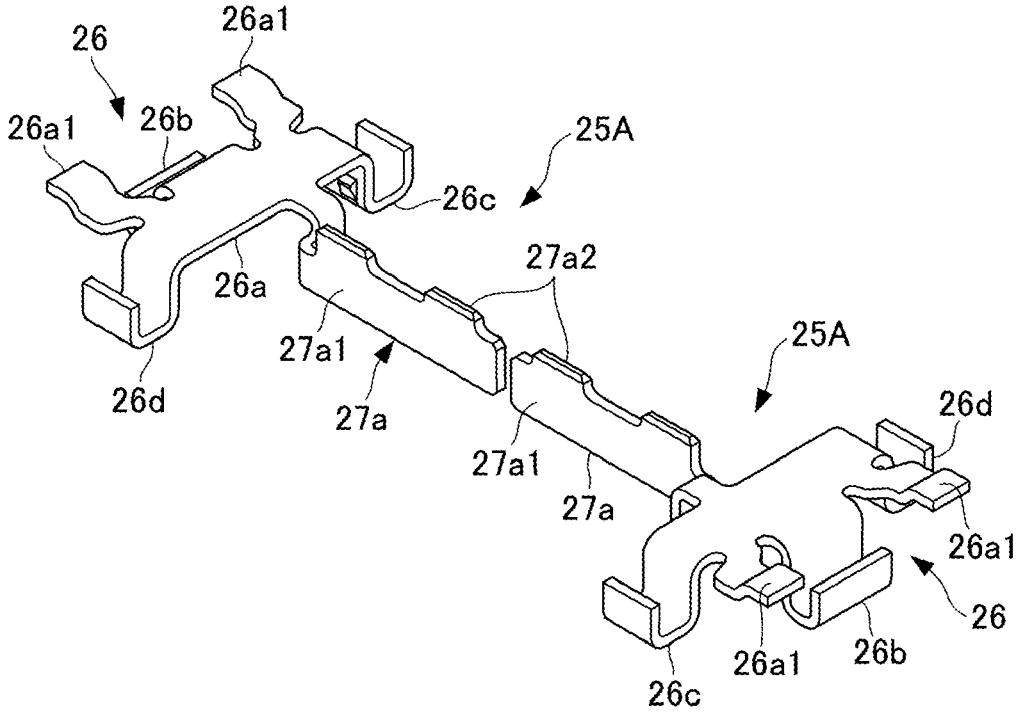
FIG. 6B is a perspective view of conductive members attached to the connector housing of the electric connector (socket) according to the first embodiment of the present invention, showing its exterior on a bottom side.

Next, the configuration of the conductive members 25A and the reinforcing metal piece 24 attached to the connector housing 21 of the electric connector 20A will be described in detail. FIGS. 6A and 6B include perspective views showing the configuration of the conductive members 25A, and FIG. 7 includes perspective views showing a disposition state of the conductive members 25A and the connection terminal rows 22*a* and 22*b*.

As shown in FIGS. 6A and 6B, the conductive member 25A is composed of a conductive member, and has the first plate 26, the second plate 27*a*, and a joint plate 28 for joining the first plate 26 and the second plate 27*a*. In the connector housing 21, the first plates 26 are attached to the connector housing 21 on both outsides of the connection terminal rows 22*a* and 22*b* in the row direction of the connection terminals, and the second plates 27*a* extend between the connection terminal rows 22*a* and 22*b* in the row direction of the connection terminals.

The electric connector 20A according to the present embodiment is specifically configured (see FIGS. 6A to 7, and 9A to 11B) such that the two conductive members 25A having the above-described structure are arranged in the row direction of the connection terminals of the connection terminal rows 22*a* and 22*b* so as to bring end portions of the second plates 27*a* on the opposite sides to the first plates 26 close to each other.

As shown in FIGS. 6A and 6B, each of the two conductive members 25A is composed of an integral body in which the first plate 26 and the second plate 27*a* are joined with the joint plate 28. In the conductive member 25A, the joint plate 28 is orthogonal to a plate surface 26*a* of the first plate 26 and a plate surface 27*a*1 of the second plate 27*a*. The joint plate 28 may be provided so as to be exposed from the connector housing 21 on the outsides of the connection terminal rows 22*a* and 22*b* in the row direction thereof. For example, the joint plates 28 are disposed in a state of being exposed from side surfaces on both ends of the terminal holder 21*j* of the connector housing 21 in the row direction of the connection terminal rows 22*a* and 22*b* and partly being in contact with the side surfaces.

Out of the first plate 26 and the second plate 27*a* of the conductive member 25A, the second plate 27*a* is composed of a plate member having the plate surface 27*a*1, which is a flat surface extending in an fitting and removal direction (a Z direction in FIG. 1) of the connector bodies 20 and 30 of the electric connector 20A and the counterpart electric connector 30A and in the row direction (a Y direction in FIG. 1) of the connection terminal rows 22*a* and 22*b*. In the second plate 27*a*, the external joint portions 27*a*2 are formed on a bottom end side surface of the plate surface 27*a*1 at predetermined intervals along the row direction (Y direction in FIG. 1) of the connection terminal rows 22*a* and 22*b*.

In the conductive member 25A, the first plate 26 has the plate surface 26*a*, which is a flat surface extending in the fitting and removal direction and in the row width direction (X direction in FIG. 1) of the connection terminal rows 22*a* and 22*b*, and the side end plates 26*b*, 26*c*, and 26*d* erected from three end portions, except for a connection end to the joint plate 28, of the plate surface 26*a* along the fitting and removal direction.

The side end plate 26*b* is erected from an end portion, opposite the connection end of the joint plate 28, of the plate surface 26*a*. The side end plate 26*b* is a portion on which the pairs of internal and external edge plate portions 24*c* of the reinforcing metal piece 24 are partly overlaid, when the reinforcing metal piece 24 is mounted on the connector housing 21 to which the conductive members 25A are attached. The pairs of internal and external edge plate portions 24*c* of the reinforcing metal piece 24 overlaid on the side end plates 26*b* define both side ends of the depressed fitting portion 21*a* of the connector housing 21 in the row direction of the connection terminal rows 22*a* and 22*b*. Note that, in the plate surface 26*a* from which the side end plate 26*b* is erected, the pair of external joint portions 26*a*1, part of which extend outside at both sides of the side end plate 26*b*, are formed.

The side end plates 26*c* and 26*d* are erected from end portions, adjacent to the connection end of the joint plate 28, of the plate surface 26*a*. The side end plates 26*c* and 26*d* define both side ends of the depressed fitting portion 21*a* of the connector housing 21 in the row width direction of the connection terminal rows 22*a* and 22*b*.

In the first plate 26, the side end plate 26*b* has a curved extending portion 26*b*1 that protrudes outside in the row direction of the connection terminal rows 22*a* and 22*b* at a top end portion and is bent outside a base portion of the side end plate 26*b*. The extending portion 26*b*1 forms a groove portion 26*b*2 between its distal end portion and an unbent portion (the base portion of the side end plate 26*b*) of the side end plate 26*b*. In the same manner, in the first plate 26, the side end plates 26*c* and 26*d* have curved extending portions 26*c*1 and 26*d*1 that protrude outside in the row width direction of the connection terminal rows 22*a* and 22*b* and are bent outside base portions of the side end plates 26*c* and 26*d*, respectively. The extending portions 26*c*1 and 26*d*1 form groove portions 26*c*2 and 26*d*2 between each of their distal end portions and each of unbent portions (base portions of the side end plates 26*c* and 26*d*) of the side end plates 26*c* and 26*d*.

The groove portions 26*b*2, 26*c*2, and 26*d*2 formed in the first plate 26 of the conductive member 25A function as engagement depressed portions into which engagement protruding portions formed in the connector housing 21 correspondingly to the groove portions 26*b*2, 26*c*2, and 26*d*2 are engaged, respectively. As the above-described engagement protruding portions, the connector housing 21 has row-directional engagement portions 21*e* (see FIGS. 9A and 9B) that are engaged with the groove portions 26*b*2 of the pair of side end plates 26*b* on both outsides in the row direction of the connection terminal rows 22*a* and 22*b*, and row width-directional engagement portions 21*f* (see FIGS. 10A and 10B) that are engaged with the groove portions 26*c*2 and 26*d*2 of the side end plates 26*c* and 26*d*, respectively, on both outsides in the row width direction of the connection terminal rows 22*a* and 22*b*.

In the conductive member 25A, the engagement protruding portion 26*f*, which is engaged with the engagement depressed portion 34*f* provided in the connector body 30 of the counterpart electric connector 30A, is formed in each of the side end plates 26*c* and 26*d* of the first plate 26. The engagement protruding portions 26*f* are composed of a pair of elastic projection members provided symmetrically on both sides in the row width direction of the connection terminal rows 22*a* and 22*b*. A pair of the engagement protruding portions 26*f* are provided on each of both sides in the row direction of the connection terminal rows 22*a* and 22*b*.

Figure 7:
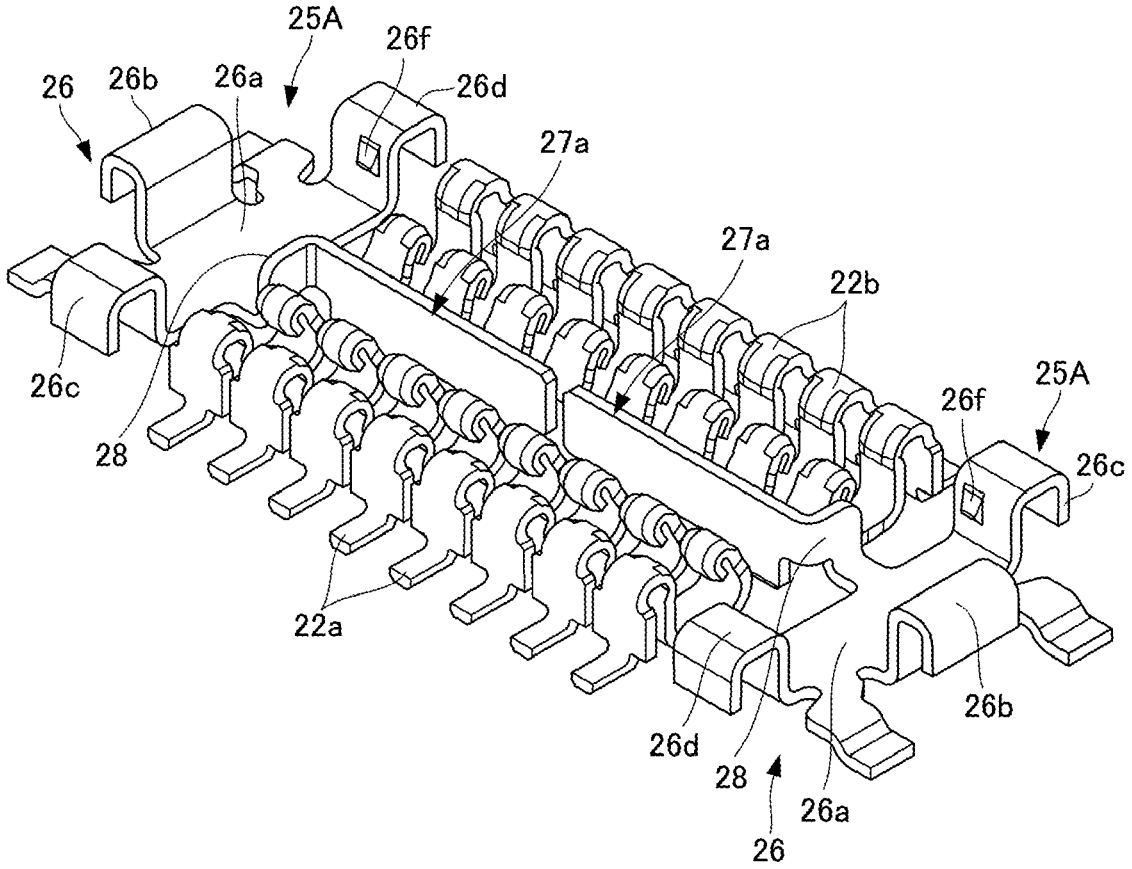
FIG. 7 is a perspective view showing a disposition state of the conductive members and connection terminal rows in the connector housing of the electric connector (socket) according to the first embodiment of the present invention.

In the electric connector 20A including the connector housing 21 to which the two conductive members 25A having the configuration shown in FIGS. 6A and 6B are attached, the two conductive members 25A and the connection terminal rows 22*a* and 22*b* have, for example, a positional relationship as shown in FIG. 7 in the connector housing 21. More specifically, the two conductive members 25A and the connection terminal rows 22*a* and 22*b* are disposed such that the second plates 27*a* of the respective conductive members 25A are inserted between the connection terminal rows 22*a* and 22*b*. In this disposition state, each of the conductive members 25A is connected to a wiring pattern on the circuit substrate P (see FIG. 2) on the side of the substrate facing surface 21*c* of the connector housing 21 through the external joint portions 27*a*2 provided in the second plate 27*a*, thus providing electric continuity through the wiring pattern.

The conductive members 25A are integrated into the connector housing 21 by insert molding, or press-fitted into the connector housing 21 that has been molded.

In the electric connector 20A according to the present embodiment, the two conductive members 25A and the connection terminal rows 22*a* and 22*b* are insert molded in the connector housing 21 by, for example, disposing the two conductive members 25A and the connection terminal rows 22*a* and 22*b* in a frame of the connector housing 21 in the positional relationship shown in FIG. 7 and pouring a synthetic resin into the frame. In an exploded perspective view of the connector housing 21 shown in FIG. 8, a lower part shows external structure of the connector housing 21 obtained by insert molding.

Figure 4A:
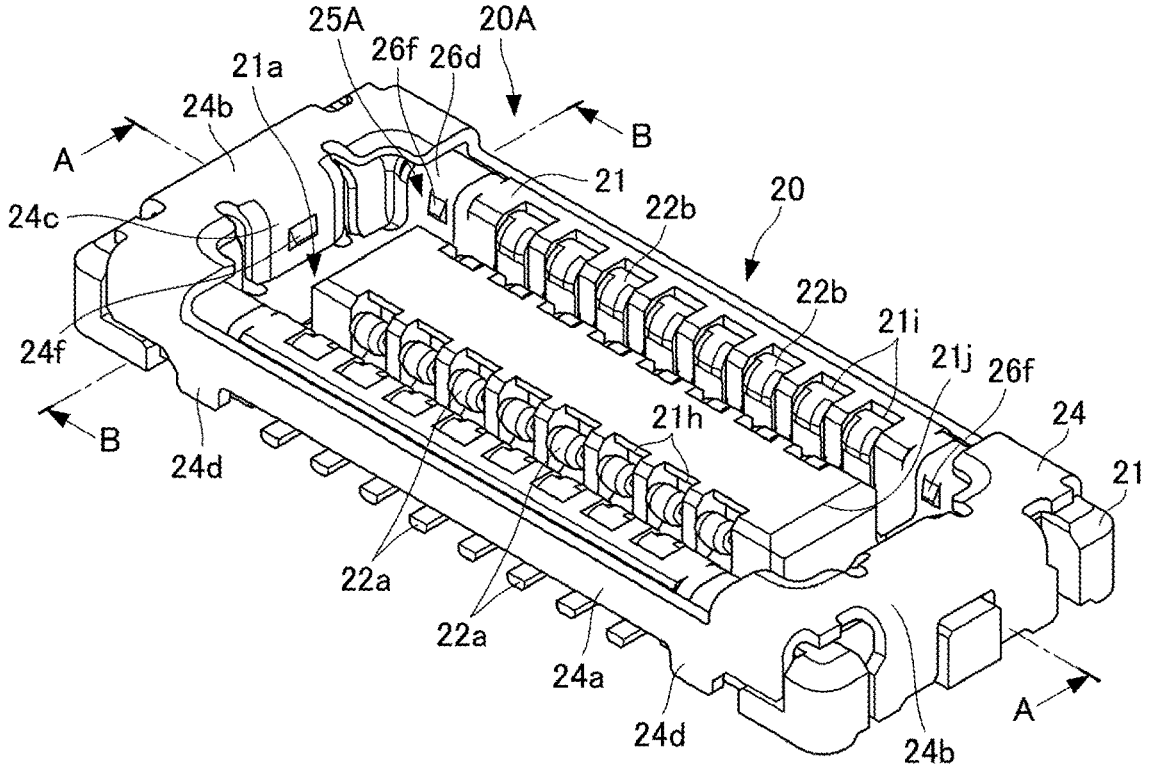
FIG. 4A is an exterior perspective view of the electric connector (socket) according to the first embodiment of the present invention, showing its exterior on a top side.
Figure 4B:
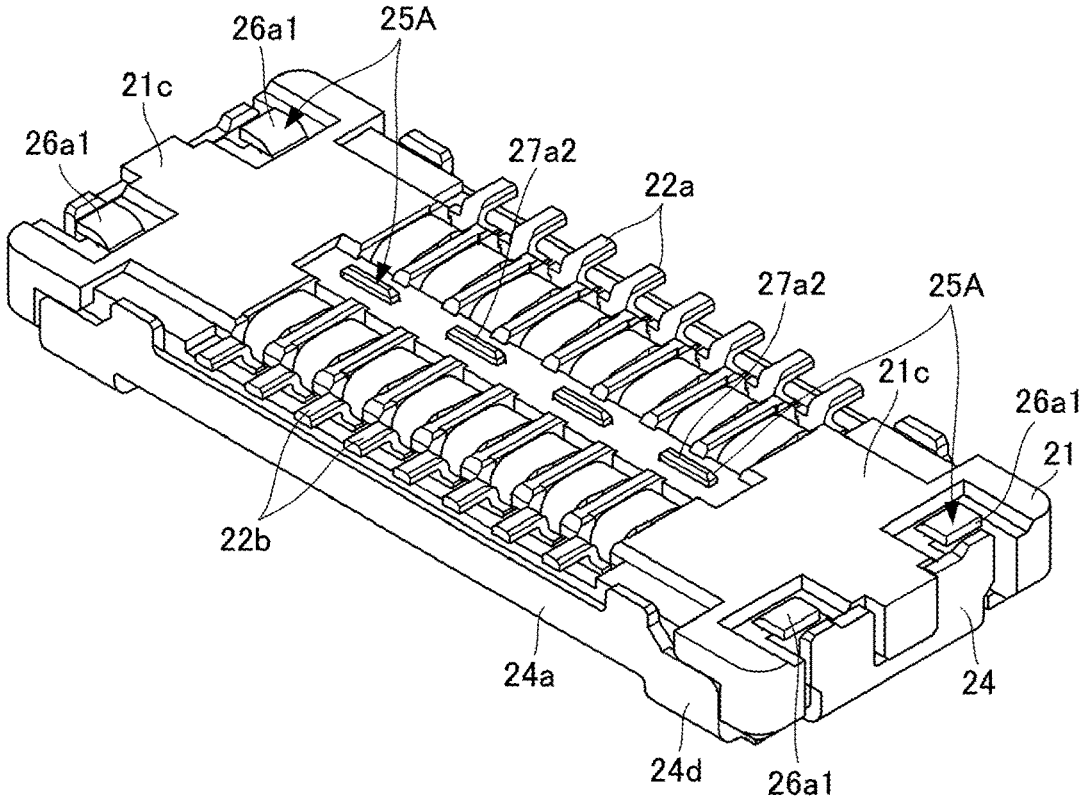
FIG. 4B is an exterior perspective view of the electric connector (socket) according to the first embodiment of the present invention, showing its exterior on a bottom side.
Figure 8:
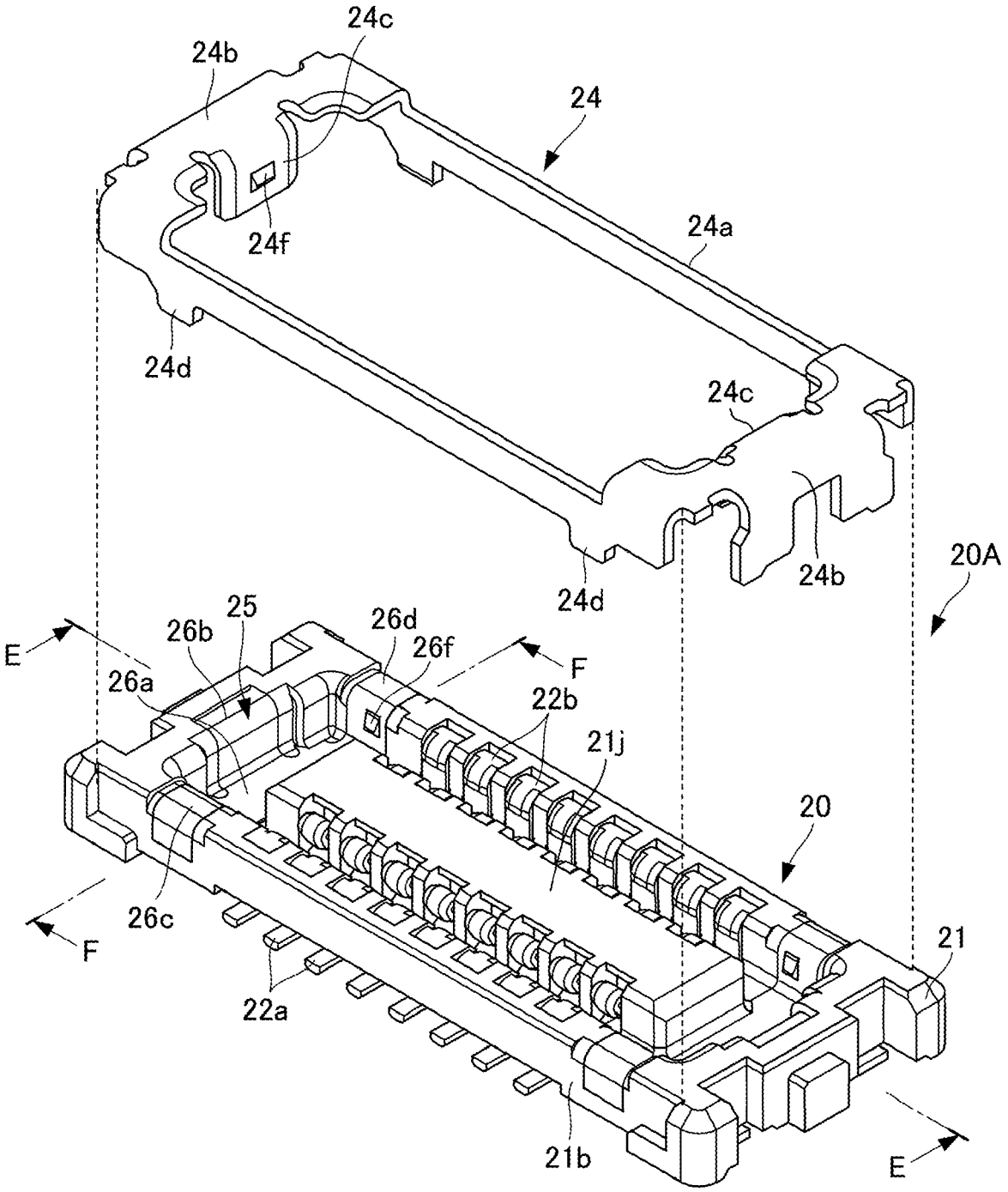
FIG. 8 is an exploded perspective view of the electric connector (socket) according to the first embodiment of the present invention, and an upper side shows an exterior of a reinforcing metal piece, and a lower side shows an exterior of the connector housing to which the conductive members are attached.

As shown in FIG. 8, the connector housing 21 obtained by insert molding can become, for example, the electric connector 20A having the connector body 20 having the structure shown in FIG. 4A by mounting the reinforcing metal piece 24 (see an upper part of FIG. 8) from above.

Figure 9A:
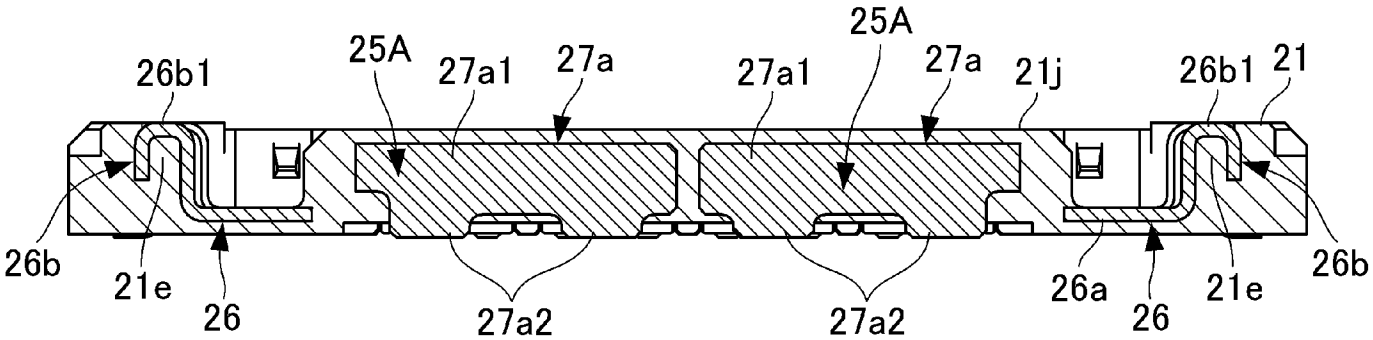
FIG. 9A is a longitudinal cross-sectional view of the connector housing of the electric connector (socket) according to the first embodiment of the present invention, in a state that the reinforcing metal piece is not mounted thereon.

For ease of understanding of the internal structure of the electric connector 20A according to the present embodiment, FIGS. 9A to 11B show the cross-sectional structure thereof. FIG. 9A is a longitudinal cross-sectional view (cross-sectional view taken along line E-E of FIG. 8) of the connector housing 21 of the electric connector 20A in the longitudinal direction in a state that the reinforcing metal piece 24 is not mounted, and FIG. 9B is a transverse cross-sectional view (cross-sectional view taken along line F-F of FIG. 8) of a longitudinal middle portion of the connector housing 21. FIG. 10A is a longitudinal cross-sectional view (sectional view taken along line A-A of FIGS. 4A and 4B) of the connector housing 21 of the electric connector 20A in a state that the reinforcing metal piece 24 is mounted thereon, and FIG. 10B is a transverse cross-sectional view (cross-sectional view taken along line B-B of FIG. 4A) of an end portion of the connector housing 21 in the longitudinal direction.

Figure 9B:
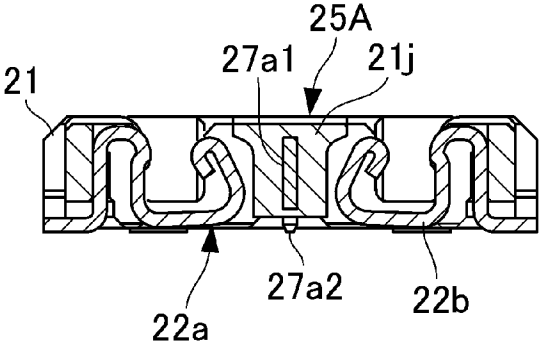
FIG. 9B is a transverse cross-sectional view of a longitudinal middle portion of the socket.

As shown in FIGS. 9A and 9B, in the connector housing 21 of the electric connector 20A, the terminal holder 21*j* contains the second plates 27*a* extending from the first plates 26 of the conductive members 25A therein. The second plates 27*a* have the plate surfaces 27*a*1 that are parallel with a protrusion-depression engagement direction with the counterpart electric connector 30A, and the conductive member 25A is attached to the terminal holder 21*j* such that, as shown in FIG. 9B, the second plates 27*a* are situated at the middle portion in the row width direction of the connection terminal rows 22*a* and 22*b*.

Figure 10A:
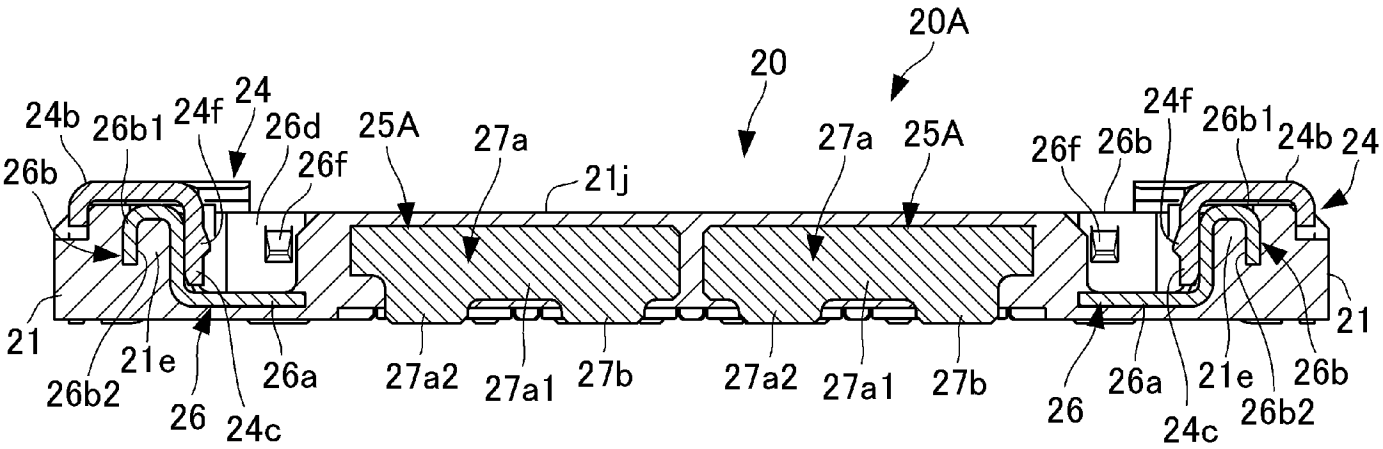
FIG. 10A is a longitudinal cross-sectional view of the connector housing of the electric connector (socket) according to the first embodiment of the present invention, in a state that the reinforcing metal piece is mounted thereon.

As shown in FIG. 10A, as to the relationship between the connector housing 21 and the conductive members 25A in the longitudinal direction of the connector housing 21 in the electric connector 20A according to the present embodiment, the row-directional engagement portions 21*e* of the connector housing 21 are engaged with the groove portions

26*b*2 of the side end plates 26*b* of the first plates 26 of the conductive members 25A at both ends in the longitudinal direction. Likewise, as to the relationship between the conductive members 25A and the reinforcing metal piece 24, part of the internal surfaces of the pair of connection plate portions 24*b* of the reinforcing metal piece 24 are partly overlapped with the top surfaces of the extending portions 26*b*1 of the side end plates 26*b* of the first plates 26 of the conductive members 25A. Furthermore, the internal surfaces of the pairs of internal and external edge plate portions 24*c* of the reinforcing metal piece 24 are in contact with the base portions of the side end plates 26*b* of the first plates 26 of the conductive members 25A.

Figure 10B:
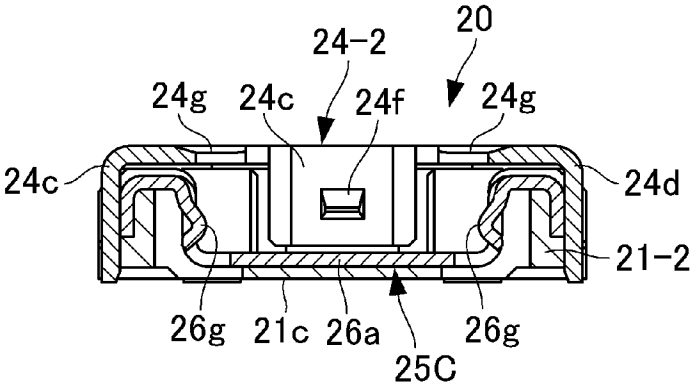
FIG. 10B is a transverse cross-sectional view of an end portion of the socket in a longitudinal direction.

In the electric connector 20A, as to the relationship between the connector housing 21 and the conductive members 25A in a lateral direction of the connector housing 21, as shown in FIG. 10B, the row width-directional engagement portions 21*f* of the connector housing 21 are engaged with the groove portions 26*c*2 and 26*d*2 of the side end plates 26*c* and 26*d* of the first plates 26 of the conductive members 25A at both ends in the lateral direction of the connector housing 21. As to the relationship between the conductive members 25A and the reinforcing metal piece 24, the internal surfaces of the pairs of bent joint portions 24*d* of the reinforcing metal piece 24 are in contact with the external surfaces of the extending portions 26*c*1 and 26*d*1 of the side end plates 26*c* and 26*d* of the first plates 26 of the conductive members 25A.

Figure 3A:
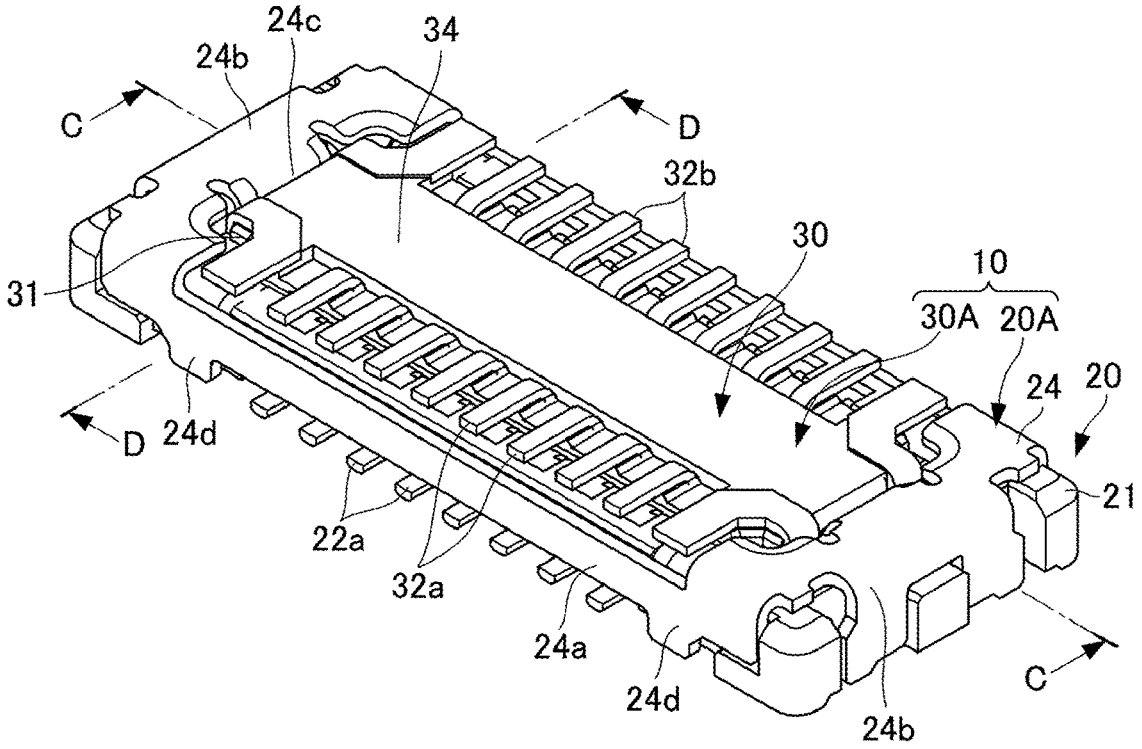
FIG. 3A is a perspective view showing a male and female connection state of a socket and a plug of the electric connector set according to the first embodiment of the present invention, showing its top side.
Figure 3B:
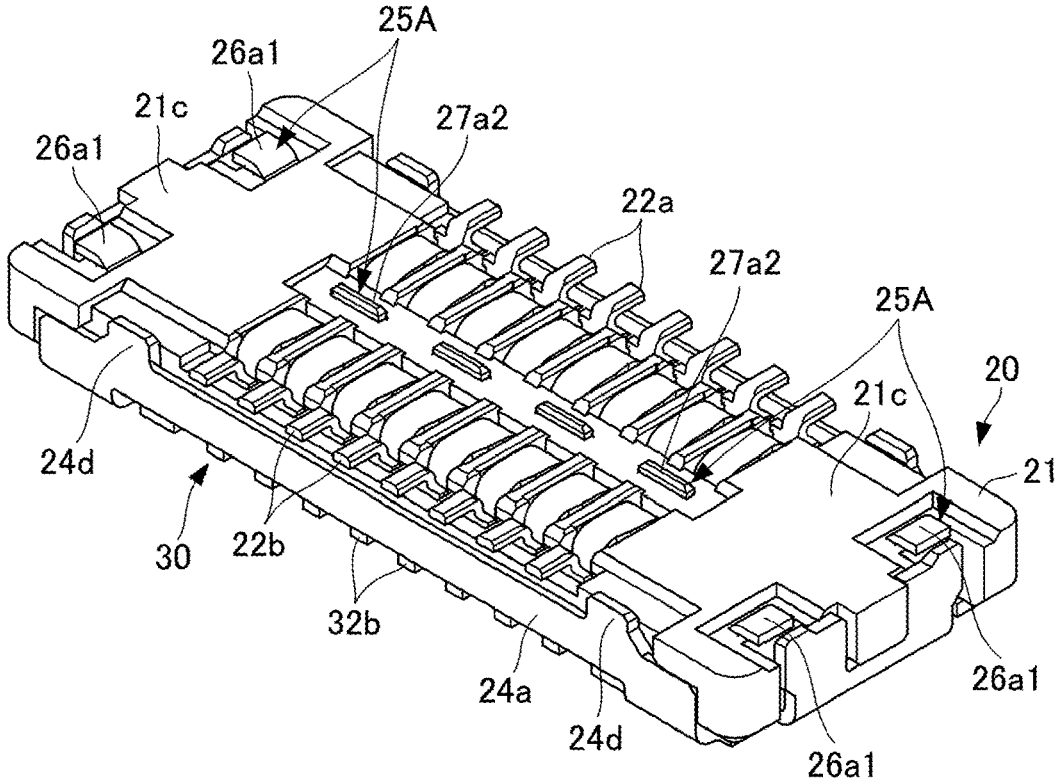
FIG. 3B is a perspective view showing a male and female connection state of the socket and a plug of the electric connector set according to the first embodiment of the present invention, showing its bottom side.
Figure 11A:
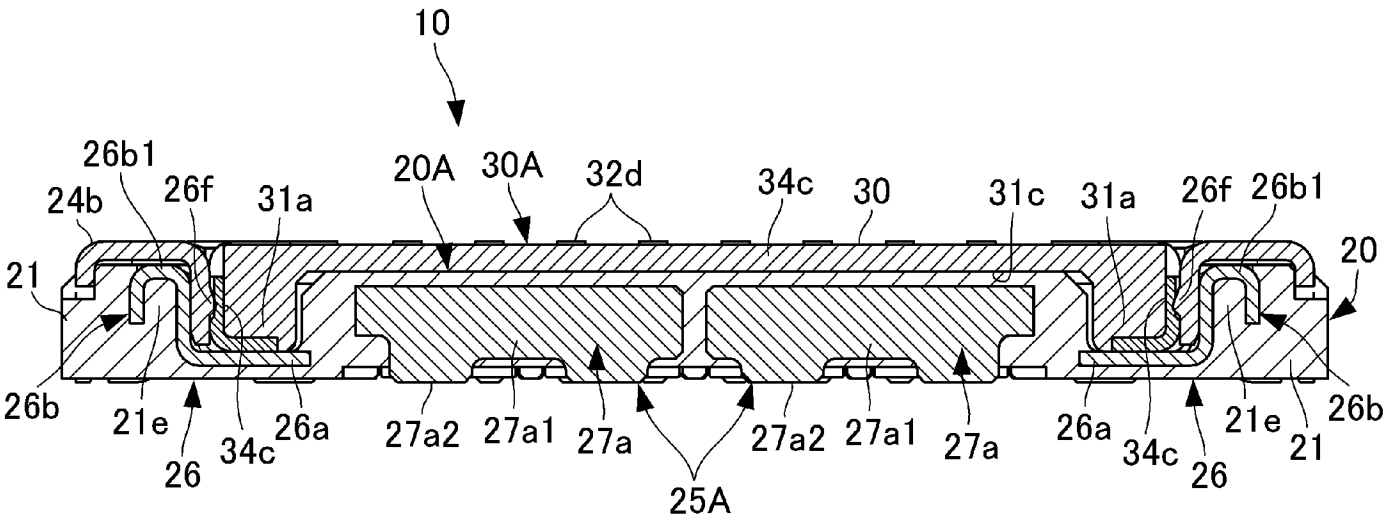
FIG. 11A is a longitudinal cross-sectional view showing a male and female connection state of the socket and the plug in the electric connector set according to the first embodiment of the present invention.

The electric connector 20A can become the electric connector set 10 having the external structure, as shown in FIGS. 3A and 3B, by being male-female fitted (protrusion-depression engaged) with the counterpart electric connector 30A. FIG. 11A is a longitudinal cross-sectional view (cross-sectional view taken along line C-C of FIG. 3A) showing a male and female connection state of the socket and the plug in the longitudinal direction in the electric connector set 10, and FIG. 11B is a transverse cross-sectional view (cross-sectional view taken along line D-D of FIG. 3A) of an end portion of the electric connector set 10 in the longitudinal direction.

Figure 11B:
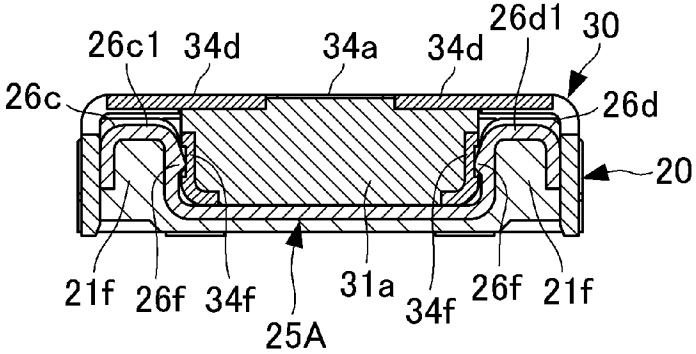
FIG. 11B is a transverse cross-sectional view of an end portion of the electric connector set in the longitudinal direction.

As shown in FIGS. 11A and 11B, in the electric connector set 10, the counterpart electric connector 30A can be protrusion-depression engaged with the electric connector 20A in a state such that a part of the reinforcing metal piece 24 (pair of connection plate portions 24*b*) is in contact with the top surfaces of the extending portions 26*b*1 of the side end plates 26*b* of the first plates 26 of the conductive members 25A (refer to FIG. 11A) and the top and external surfaces of the extending portions 26*c*1 and 26*d*1 of the side end plates 26*c* and 26*d* (see FIG. 11B).

In the protrusion-depression engaged electric connector set 10, the side end plates 26*b*, 26*c*, and 26*d* of the conductive members 25A are electrically connected to the pair of connection plate portions 24*b*, the pairs of internal and external edge plate portions 24*c*, and the pairs of bent joint portions 24*d* of the reinforcing metal piece 24, and the plate surfaces 26*a* of the first plates 26 of the conductive members 25A are retained with and electrically connected to both the edge plate portions 34*b* of the reinforcing metal piece 34 of the counterpart electric connector 30A. Therefore, in the electric connector set 10, when the connector bodies 20 and 30 of the electric connector 20A and the counterpart electric connector 30A are joined, both the reinforcing metal pieces 24 and 34 can become electrically conductive through the conductive members 25A.

As described above, in the electric connector 20A for actualizing the electric connector set 10 according to the present embodiment, the conductive members 25A attached to the connector housing 21 can be used as connection terminals to provide electric conductivity in conductive paths.

As described above, when being used as the electric connector set 10, each of the conductive members 25A attached to the connector housing 21 is connected to the wiring pattern of the circuit substrate P (see FIG. 2) on the side of the substrate facing surface 21*c* of the connector housing 21 through the external joint portions 27*a*2 provided in the second plate 27*a*. Each of the conductive members 25A can function as a power terminal or a signal terminal depending on whether the connected wiring pattern is a wiring pattern Wp1 for power supply or a wiring pattern Wp2 for a signal such as a control signal (see FIGS. 12A, 12B and 15).

The terminal operation pattern of the conductive members 25A in the electric connector 20A according to the present embodiment will be described with reference to FIGS. 12A and 12B.

In the electric connector 20A according to the present embodiment, the two conductive members 25A are attached to the connector housing 21 (see FIGS. 6A to 7, and 9A to 11B). Thus, as an example of the terminal operation pattern of the electric connector 20A, for example, as shown in FIG. 12A, one of the conductive members 25A can be used as a positive power terminal, while the other can be used as a negative power terminal. This terminal operation pattern is based on the premise that the external joint portions 27*a*2 of each conductive member 25A are connected to the wiring pattern Wp1 for power supply on the circuit substrate P (see FIG. 2) on the side of the substrate facing surface 21*c* of the connector housing 21.

In the electric connector 20A, both the two conductive members 25A corresponding to the positive and negative power terminals have larger volumes and surface areas of the power terminals than those in the case of using only the first plates 26 situated outsides in the row direction, due to the second plates 27*a* extending from the first plates 26 situated outsides in the row direction of the connection terminals of the connection terminal rows 22*a* and 22*b* along the row direction to the inside of the terminal holder 21*j*. Therefore, in the terminal operation using the pattern shown in FIG. 12A, increases in the volumes and surface areas of the terminals, as compared with the case of using only the first plates 26 as power terminals, improve a heat dissipation effect and a heat generation inhibiting effect.

Figure 12A:
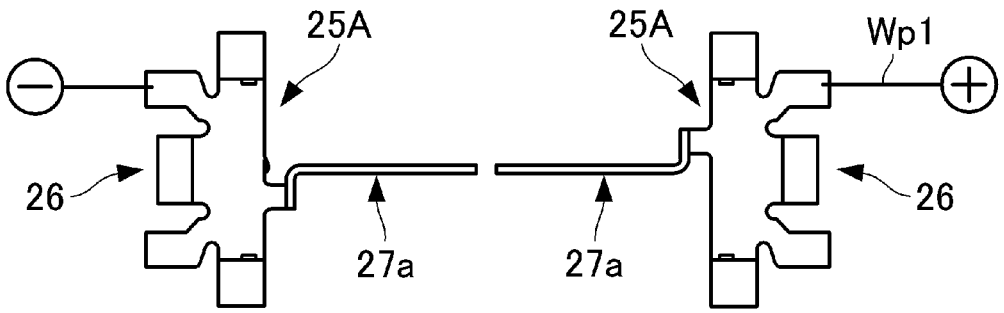
FIG. 12A is a schematic view showing a terminal operation pattern of the conductive members in the electric connector (socket) according to the first embodiment of the present invention, showing a pattern in which the conductive members are used as positive and negative power terminals.
Figure 12B:
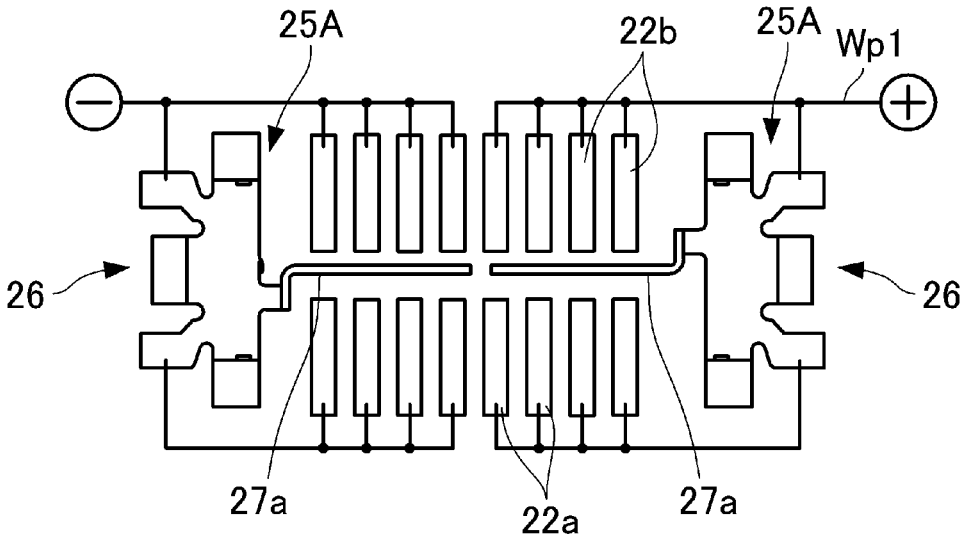
FIG. 12B is a schematic view showing the terminal operation pattern of the conductive members in the electric connector (socket) according to the first embodiment of the present invention, showing a pattern in which the conductive members and nearby connection terminals of the connection terminal rows are used as positive and negative power terminals.

The electric connector 20A, in which the two conductive members 25A are attached to the connector housing 21, can adopt, for example, terminal operation of a pattern shown in FIG. 12B. More specifically, in FIG. 12B, based on the premise that one of the conductive members 25A is used as a positive power terminal and the other is used as a negative power terminal (refer to FIG. 12A), the connection terminal rows 22*a* and 22*b* on the side of one of the conductive members 25A (close to one of the conductive members 25A) are used as the same positive power terminals as one of the conductive members 25A, while the connection terminal rows 22*a* and 22*b* on the side of the other conductive member 25A (close to the other conductive member 25A) are used as the same negative power terminals as the other conductive member 25A, with respect to a middle portion of the connection terminals of the connection terminal rows 22*a* and 22*b* in the row direction.

In FIG. 12B, the numbers of the connection terminals of the connection terminal rows 22*a* and 22*b* that are used as the positive and negative power terminals together with one and the other conductive members 25A can be arbitrarily determined. In this case, the connection terminal rows 22*a* and 22*b* used as the positive power terminals and the connection terminal rows 22*a* and 22*b* used as the negative power terminals are required to be connected to lands to which one and the other conductive members 25A are connected, respectively, of the wiring pattern Wp1 for power supply on the circuit substrate P (see FIG. 2), on the side of the substrate facing surface 21*c* of the connector housing 21. The terminal operation using the pattern shown in FIG. 12B provides an increased volume (surface area) of the power terminals, as compared with the terminal operation using the pattern shown in FIG. 12A, so that it is possible to further improve the heat generation inhibiting effect.

In the electric connector 20A, as described in the "problems to be solved by the invention" section, using the conductive members 25A as the power terminals and the like requires supplying a large current, while suppressing heat generation at terminal portions. As to this point, the electric connector 20A of the present embodiment has a contrivance to increase the volume (surface area) of the second plate 27*a* in the structure of the conductive member 25A used as a terminal. For example, in the conductive member 25A, the second plate 27*a*, which is joined to the first plate 26 through the joint plate 28, extends longer than ever before in the row direction of the connection terminal rows 22*a* and 22*b*.

To be more specific, for example, as shown in FIGS. 7 and 9A to 11B, the conductive member 25A has the second plate 27*a* that extends from the end portion of the first plate 26 on the side of the terminal holder 21*j* to the inside of the terminal holder 21*j* in the row direction of the connection terminal rows 22*a* and 22*b*.

In particular, in the present embodiment, the conductive member 25A has the second plate 27*a* that extends to a middle position of the connection terminal rows 22*a* and 22*b* in the terminal holder 21*j* having the terminal holding portions 21*h* and 21*i* for holding the connection terminals of the connection terminal rows 22*a* and 22*b*.

In the present embodiment, as to the configuration in which the second plate 27*a* of the conductive member 25A extends to the inside of the terminal holder 21*j*, an extending portion of the conductive member 25A to the inside of the terminal holder 21*j* has a structure in which its angle varies inside the terminal holder 21*j* in a plate thickness direction.

To be more specific, the conductive member 25A is configured such that the conductive member 25A has the joint plate 28 for joining the first plate 26 and the second plate 27*a*, and the joint plate 28 is orthogonal to the plate surface 26*a* of the first plate 26 and the plate surface 27*a*1 of the second plate 27*a*. Note that, in the present embodiment, as to the configuration of the above-described "its angle varies inside the terminal holder 21*j* in a plate thickness direction" relating to the conductive member 25A, the joint plate 28 is not necessarily orthogonal to the plate surface 26*a* of the first plate 26 and the plate surface 27*a*1 of the second plate 27*a*, as long as it intersects at a predetermined angle.

As described above, in the electric connector 20A according to the present embodiment, the connector housing 21 is provided in a protruding manner in an opposite position to the middle depressed portion 31*c* of the protruding fitting portion 31*a* of the counterpart electric connector 30A relative to the depressed fitting portion 21*a*. The connector housing 21 has the terminal holder 21*j* for holding one end of each of the connection terminals of the connection terminal rows 22*a* and 22*b*.

The electric connector 20A has the conductive members 25A having the conductive first plates 26 that are attached to the connector housing 21 on both outsides of the connection terminal rows 22*a* and 22*b* in the row direction of the connection terminals. The conductive member 25A has the second plate 27*a* that extends from the end portion of the first plate 26 on the side of the terminal holder 21*j* to the inside of the terminal holder 21*j* in the row direction of the connection terminal rows 22*a* and 22*b*.

With such a configuration, the electric connector 20A according to the present embodiment has an increased volume (surface area) of the conductive members 25A, as compared with the case of using conductive members the second plates 27*a* of which do not extend to the inside of the terminal holder 21*j*. Therefore, in the electric connector 20A according to the present embodiment, when the conductive members 25A are used as terminal portions to constitute conductive paths, the temperature of the terminal portions is less likely to increase during energization, and therefore it is possible to supply a larger current, while an increase in the temperature of the terminal portions is suppressed. By suppressing an increase in the temperature of the terminal portions, the plastic deformation of peripheral portions due to the heat generation at the terminal portions can be reduced, thus allowing stabilizing electric connection.

Note that, as to the configuration of the conductive members 25A shown in FIGS. 6A and 6B, it is described that the second plates 27*a* extend to the inside of the terminal holder 21*j*, and the volumes of the conductive members 25A are increased to suppress an increase in temperature of the terminal portions during energization. However, the conductive members 25A may have a structure such that the second plates 27*a* extending from the first plates 26 have large cross sections, and heat generation resistance is reduced to suppress heat generation (the same goes for the following second to fifth embodiments).

With such a configuration of the electric connector 20A using the conductive members 25A in which the second plates 27*a* extend to the inside of the terminal holder 21*j*, based on the premise that the conductive members 25A are disposed at both sides of the connector housing 21 as terminals, it is possible to increase a stiffness at outside portions of the connector housing 21 (portions in which the first plates 26 of the conductive members 25A are disposed) against a load applied from the protruding fitting portion 31*a* of the counterpart electric connector 30A to the inside, and increase a stiffness at a portion extending inside the connector housing 21 (portions in which the connection terminal rows 22*a* and 22*b* sandwiching the second plates 27*a* of the conductive members 25A are located) against a load applied from the protruding fitting portion 31*a* of the counterpart electric connector 30A to the inside, thus preventing a break by the loads when the counterpart electric connector 30A is engaged.

In the electric connector 20A according to the present embodiment, the conductive member 25A is configured such that the second plate 27*a* extends to a position between the connection terminal rows 22*a* and 22*b* in the terminal holder 21*j*.

With such a configuration, in the electric connector 20A of the present embodiment, the second plate 27*a* extending from the first plate 26 can have an arbitrary shape contained in a region between the connection terminal rows 22*a* and 22*b* in the terminal holder 21*j*, and can have an appropriately increased volume. Since the second plate 27*a* extends between the connection terminal rows 22*a* and 22*b* in the terminal holder 21*j*, the conductive member 25A, in which the first plate 26 is integrally joined to the second plate 27*a*, has an increased strength as the terminal. Therefore, the electric connector 20A can maintain stable electric connection even during the protrusion-depression engagement with the counterpart electric connector 30A, and allows stable supply of power or signals.

In the electric connector 20A according to the present embodiment, the conductive member 25A has the joint plate 28 for joining the first plate 26 and the second plate 27*a*, and the joint plate 28 intersects the plate surface 26*a* of the first plate 26 and the plate surface 27*a*1 of the second plate 27*a*.

With such a configuration, the electric connector 20A according to the present embodiment can secure a high stiffness so as to be resistant to deformation against forces applied from different directions to the plate surface 26*a* of the first plate 26 and the plate surface 27*a*1 of the second plate 27*a* intersecting the plate surface 26*a*, when the counterpart electric connector 30A is fitted into, or removed from, the electric connector 20A. Due to the improved stiffness, the electric connector 20A is less likely to break by the forces applied when the counterpart electric connector 30A is fitted thereinto or removed therefrom, and has stable electric connection.

In short, in the electric connector 20A according to the present embodiment, as to the configuration of the conductive member 25A, a first surface and a second surface having a different angle relative to the first surface (in other words, intersecting with the first surface) may be joined in a cranked manner in the connector housing 21 (terminal holder 21*j*). Therefore, according to the present embodiment, the two surfaces (crank surfaces) formed inside the terminal holder 21*j* facilitate increasing the strength of the terminal holder 21*j* in respective directions.

According to the electric connector 20A of the present embodiment, in the conductive member 25A, the second plate 27*a* is composed of a plate member having the plate surface 27*a*1 that is parallel with the protrusion-depression engagement direction of the counterpart electric connector 30A. According to this configuration, when the conductive members 25A in which the first plates 26 are integrally joined to the second plates 27*a* are used as the terminals, the electric connector 20A according to the present embodiment has an increased strength against forces in a direction orthogonal to the plate surface 27*a*1 of the conductive member 25A, in other words, in the row width direction of the connection terminal rows 22*a* and 22*b*. Therefore, it can be expected that the electric connector 20A has a heat generation inhibiting effect and an electric connection stabilizing effect due to the extension of the second plates 27*a*, while ensuring the strength of the conductive members 25A as terminals.

In the electric connector 20A according to the present embodiment, the conductive member 25A is configured such that a part of the second plate 27*a* is exposed on the side of a top surface of the terminal holder 21*j*. In the electric connector 20A according to the present embodiment, this configuration facilitates assembling the connector housing 21 containing the conductive members 25A, as compared with the case of completely embedding the second plates 27*a* in the terminal holder 21*j* so as not to be exposed outside.

The electric connector set 10 according to the present embodiment includes the electric connector 20A having the foregoing configuration, and the electric connector 30A that is protrusion-depression engaged with the electric connector 20A in the opposed direction. With such a configuration of the electric connector set 10, in the electric connector 20A with which the counterpart electric connector 30A is protrusion-depression engaged, since the conductive members 25A have the second plates 27*a* extending from the first plates 26 to the inside of the terminal holder 21*j* in the row direction of the connection terminals, the volumes of the conductive members 25A can be increased, as compared with the case of not having the configuration in which the second plates 27*a* extend to the inside of the terminal holder 21*j*. Thus, in the electric connector set 10 according to the present embodiment, when the conductive members 25A are used as terminals constituting conductive paths, the temperature of the terminal portions is less likely to increase during energization, and hence it becomes possible to supply a larger current, while preventing the terminal portions from having a high temperature. In the electric connector set 10, since an increase in temperature of the terminal portions is prevented on the side of the electric connector 20A with which the counterpart electric connector 30A is protrusion-depression engaged, plastic deformation of peripheral portions due to the heat generation at the terminal portions can be reduced, thus allowing stabilizing electric connection.

As described above, the present embodiment can provide the electric connector 20A that allows supply of a large current, while preventing heat generation at terminal portions, and that allows stabilization of electric connection, and an electric connector set 10.

Modification Example

Figure 13:
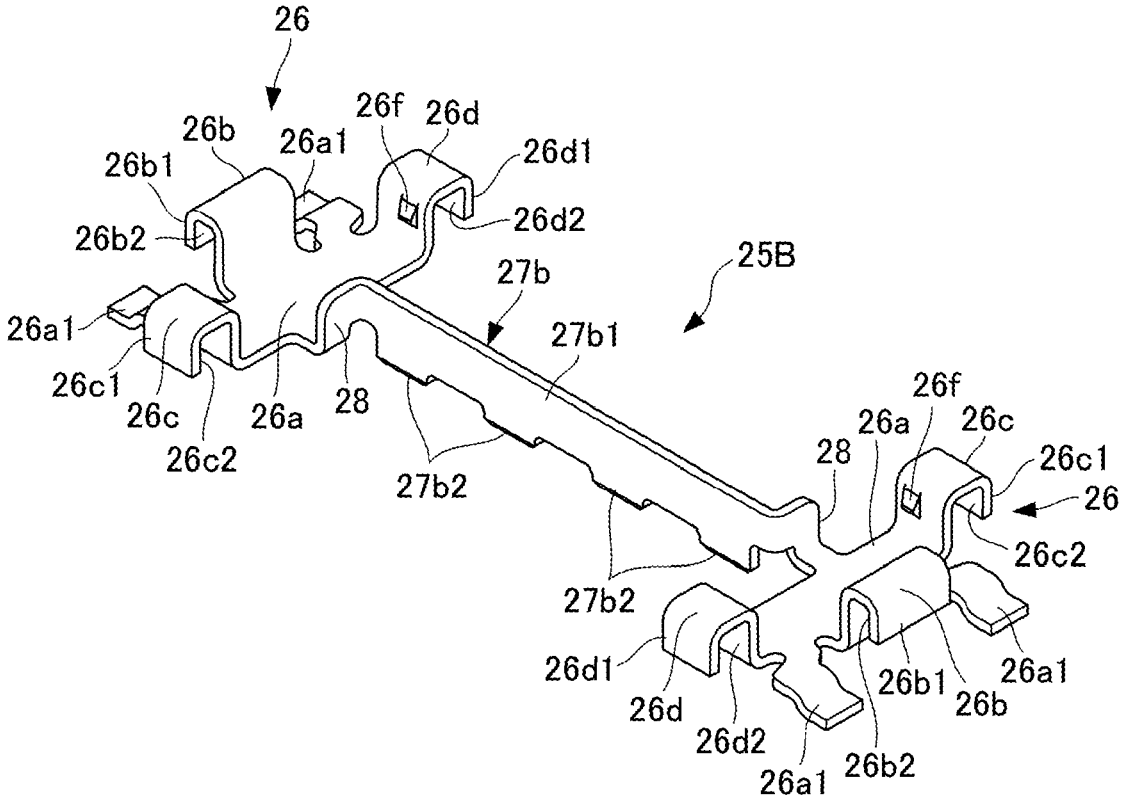
FIG. 13 is a perspective view of a conductive member attached to a connector housing of an electric connector (socket) according to a modification example of the first embodiment of the present invention.

FIG. 13 is a perspective view showing the configuration of a conductive member 25B attached to a connector housing 21-1 of an electric connector 20B according to a modification example of the first embodiment of the present invention. Since the electric connector 20B according to the modification example has the same or similar main configuration as or to the electric connector 20A according to the aforementioned first embodiment, except for the conductive member 25B attached to the connector housing 21-1, similar components to those of the first embodiment are indicated with the same reference numerals, and differences from the first embodiment will be mainly described.

The electric connector 20B according to the modification example is configured such that, as shown in FIG. 13, the two first plates 26 on both outsides of the connection terminals of the connection terminal rows 22*a* and 22*b* in the row direction are coupled with one second plate 27*b* through the respective joint plates 28. The two first plates 26 and the joint plates 28 have the same configuration as those of the first plate 26 of the conductive member 25A according to the first embodiment.

On the other hand, the second plate 27*b* is composed of a plate member having a plate surface 27*b*1 that is parallel with a protrusion-depression engagement direction with the counterpart electric connector 30A, and a plurality of external joint portions 27*b*2 are formed on a bottom end portion of the plate surface 27*b*1 in the protrusion-depression engagement direction. The configuration of the conductive member 25B corresponds to configuration that, in the two conductive members 25A (see FIGS. 6A and 6B) in the electric connector 20A according to the first embodiment, the second plate 27*a* of the conductive member 25A on one side and the second plate 27*a* of the conductive member 25A on the other side are conductively coupled on the opposite side of each first plate 26.

Figure 14:
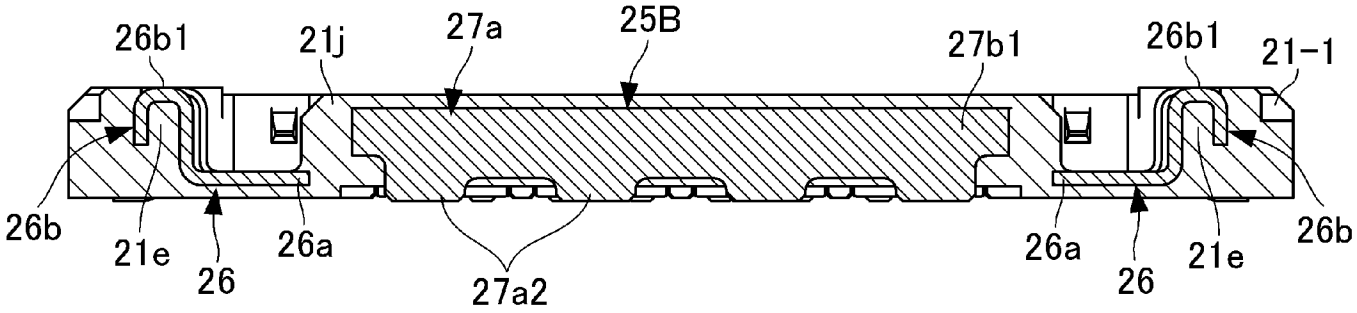
FIG. 14 is a longitudinal cross-sectional view of the connector housing of the electric connector (socket) according to the modification example of the first embodiment of the present invention in a longitudinal direction.

FIG. 14 is a longitudinal cross-sectional view of the connector housing 21-1 of the electric connector 20B according to the modification example, in the longitudinal direction. FIG. 14 specifically shows the longitudinal cross-sectional view of the same portion (refer to FIG. 9A) as that of the connector housing 21 of the electric connector 20A according to the first embodiment, in the connector housing 21-1. As shown in FIG. 14, in the electric connector 20B according to the modification example, the one second plate 27*b* is disposed inside the terminal holder 21*j* of the connector housing 21-1 so as to penetrate through the terminal holder 21*j*.

Figure 15:
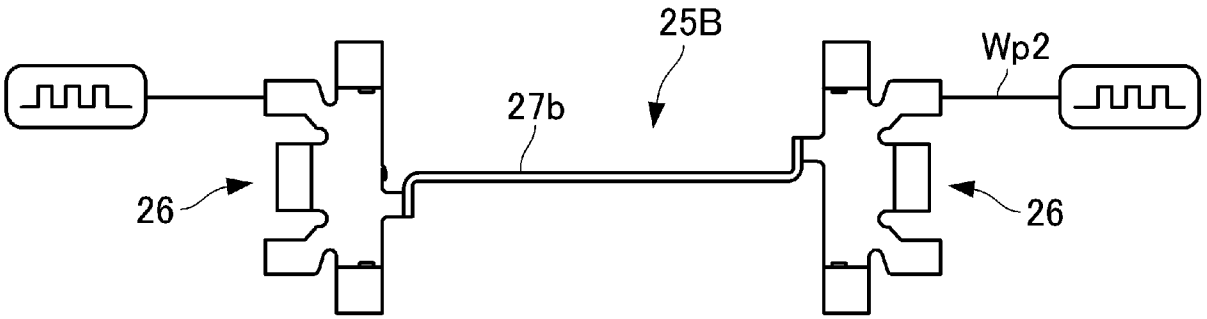
FIG. 15 is a schematic view showing a terminal operation pattern of the conductive member in the electric connector (socket) according to the modification example of the present invention.

FIG. 15 shows a terminal operation pattern of conductive member 25B in the electric connector 20B according to the modification example. According to the electric connector 20B of the modification example, since the conductive member 25B (see FIGS. 13 and 14) is composed of one conductive member extending from one end to the other end of the connector housing 21-1 in the longitudinal direction, the same operation (refer to FIGS. 12A and 12B) as the first embodiment, in which the electrically isolated two conductive members 25A are used as the positive and negative terminals, cannot be performed.

However, for example, as shown in FIG. 15, the electric connector 20B according to the modification example can be operated as a signal line for sending various signals using the one conductive member 25B, in a protrusion-depression engaged state between the electric connector 20B and the counterpart electric connector 30A. This terminal operation pattern is based on the premise that the external joint portions 27*a*2 (refer to FIG. 3B) of each conductive member 25B are connected to a wiring pattern Wp2 for a signal on the circuit substrate P (see FIG. 2) on the side of the substrate facing surface 21*c* of the connector housing 21-1.

In the terminal operation pattern shown in FIG. 15, since the second plate 27*b* extends across both the first plates 26 between the connection terminal rows 22*a* and 22*b* in the row direction of the connection terminals, the conductive member 25B can also have a large volume (surface area) as a signal terminal, and allow a large current to flow, while suppressing heat generation.

Next, second to fifth embodiments of the present invention will be described. The main configuration of electric connectors 20C, 20D, 20E, and 20F according to these embodiments are the same as or similar to that of the above-described first embodiment, and so in the following description, components similar to those of the first embodiment will be indicated with the same reference numerals, and differences from the first embodiment will be described.

Second Embodiment

Figure 16:
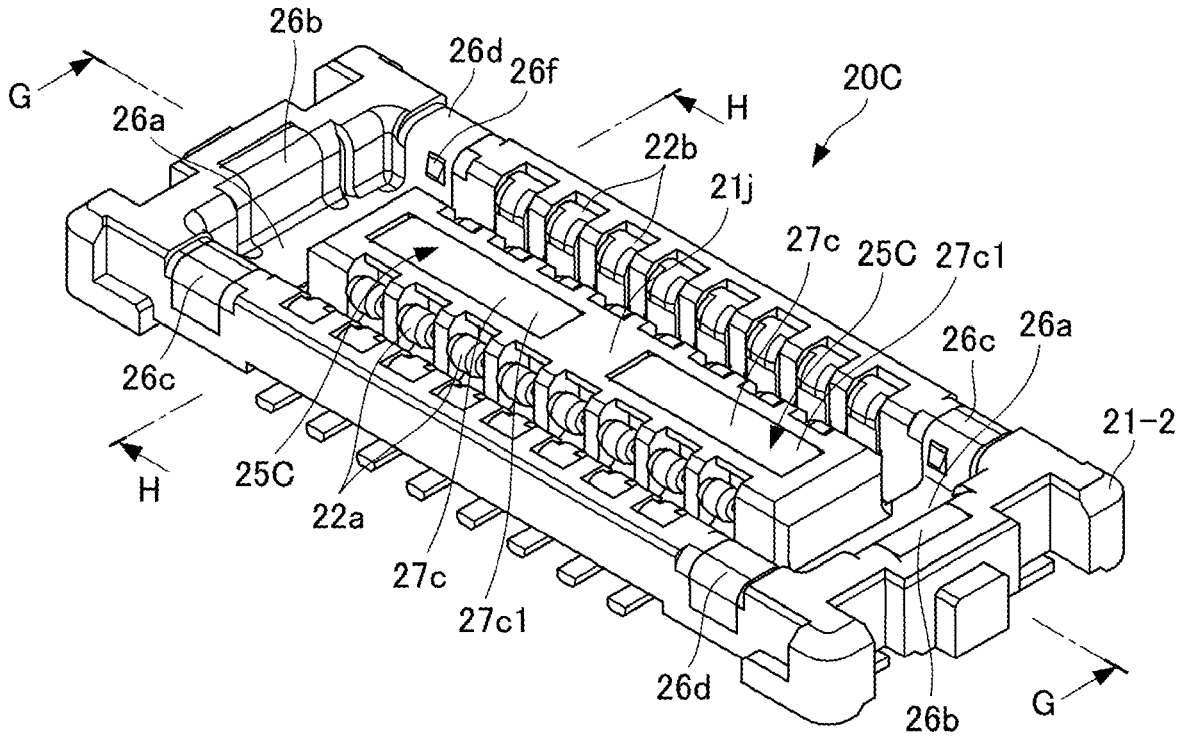
FIG. 16 is an exterior perspective view of an electric connector (socket) according to a second embodiment of the present invention.
Figure 17A:
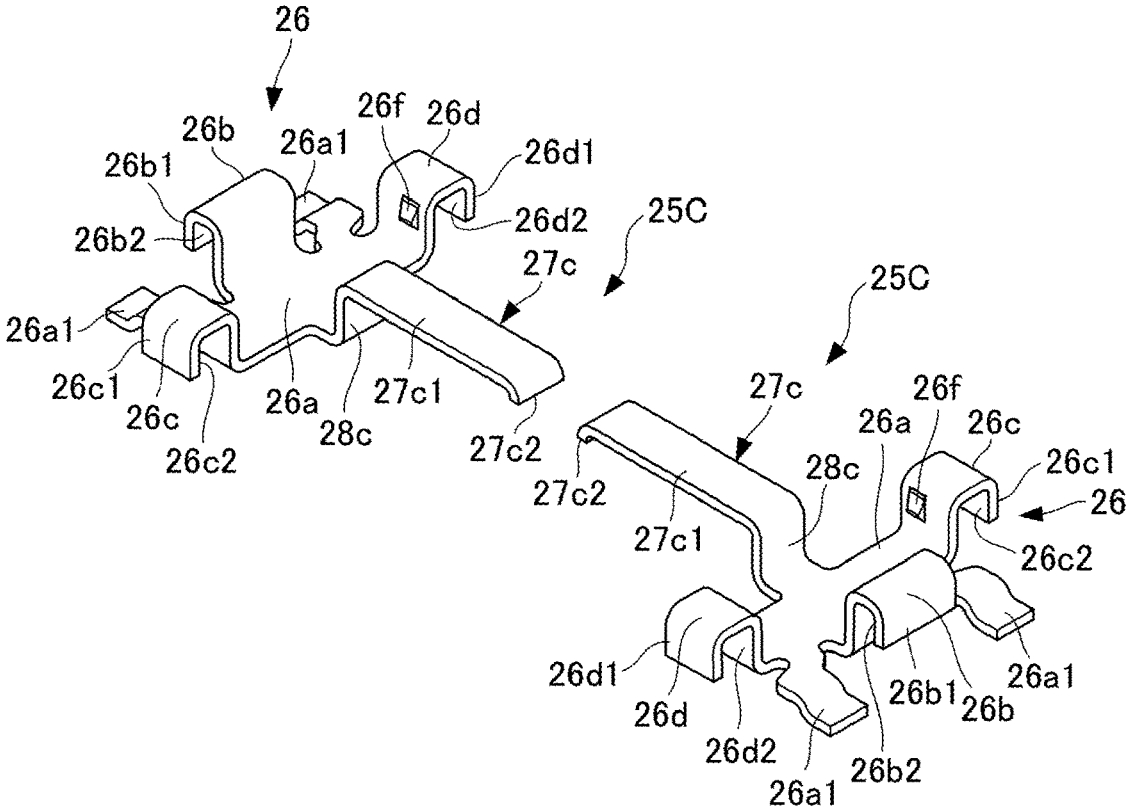
FIG. 17A is a perspective view of conductive members attached to a connector housing of the electric connector (socket) according to the second embodiment of the present invention, showing its exterior on a top side.
Figure 17B:
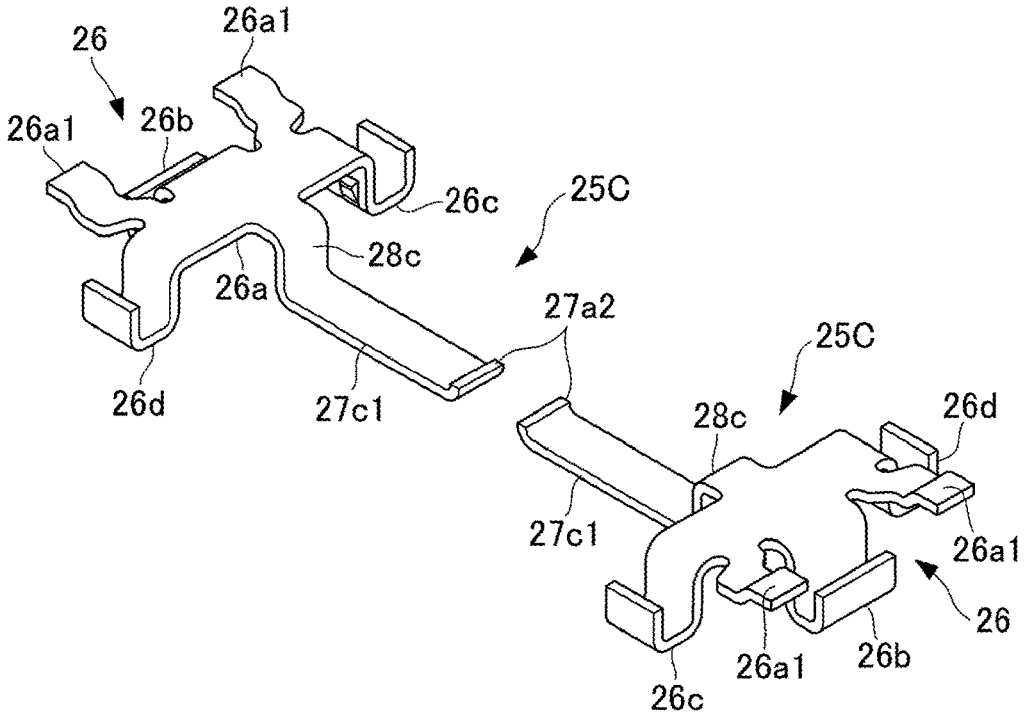
FIG. 17B is a perspective view of conductive members attached to the connector housing of the electric connector (socket) according to the second embodiment of the present invention, showing its exterior on a bottom side.
Figure 18A:
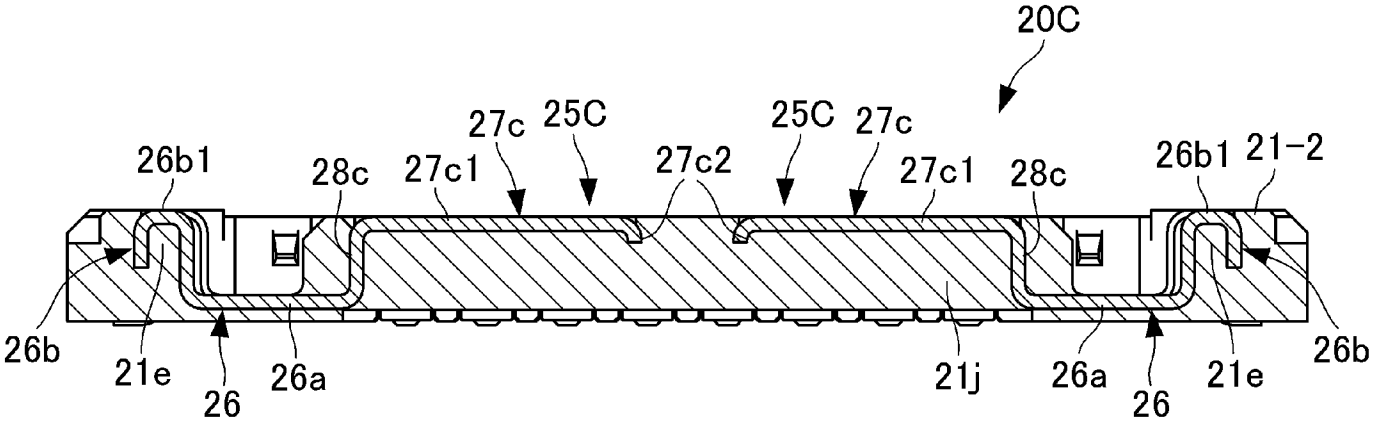
FIG. 18A is a longitudinal cross-sectional view of the connector housing of the electric connector (socket) according to the second embodiment of the present invention.
Figure 18B:
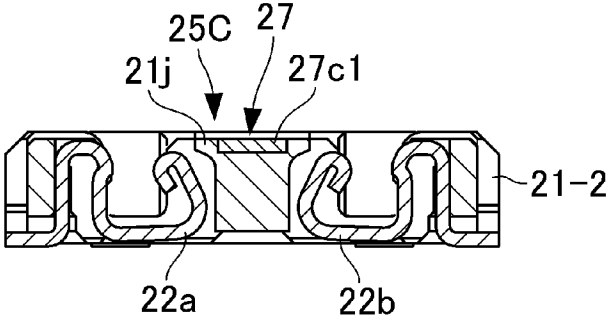
FIG. 18B is a transverse cross-sectional view of a longitudinal middle portion of the socket.

FIG. 16 is an exterior perspective view of an electric connector 20C according to a second embodiment of the present invention. FIGS. 17A and 17B include perspective views of conductive members 25C attached to a connector housing 21-2 of the electric connector 20C, and more specifically, FIG. 17A shows an exterior of its top side, and FIG. 17B shows an exterior of its bottom side. FIG. 18A is a longitudinal cross-sectional view of the connector housing 21-2 of the electric connector 20C according to the present embodiment in the longitudinal direction (cross-sectional view taken along line G-G of FIG. 16), and FIG. 18B is a transverse cross-sectional view of a longitudinal middle portion of the connector housing 21-2 (sectional view taken along line H-H of FIG. 16).

In the electric connector 20C according to the present embodiment, the conductive members 25C shown in FIGS. 17A and 17B, instead of the conductive members 25 shown in FIGS. 6A and 6B, are attached to the connector housing 21-2, as different configuration from the electric connector 20A according to the first embodiment. In the conductive member 25C, the first plate 26 has the same configuration as that of the conductive member 25A according to the first embodiment, and the configuration of a second plate 27*c* and a joint plate 28*c* is different from that of the conductive member 25A.

As shown in FIGS. 17A and 17B, in the conductive member 25C, the joint plate 28*c* is composed of a plate member that is erected by a predetermined height from an end side of the plate surface 26*a* of the first plate 26 in a vertical direction (Z direction of FIG. 1). The second plate 27*c* is composed of a longitudinal plate member having the same width as that of the joint plate 28*c*. The second plate 27*c* is joined to a top end portion of the joint plate 28*c*, and is bent at right angles and extends to the side of the other end of the first plate 26 so as to form a horizontal surface. In the conductive member 25C, the second plate 27*c* has a plate surface 27*c*1 that is perpendicular to the protrusion-depression engagement direction with the counterpart electric connector 30A, and a bent portion 27*c*2 that is bent downward at an end portion of the plate surface 27*c*1 on the opposite side to the joint plate 28*c*.

In the electric connector 20C according to the present embodiment, the two conductive members 25C having the aforementioned configuration are attached to the connector housing 21-2, in a state such that, for example as shown in FIG. 16, a part (plate surface 27*c*1) of the second plate 27*c* of each conductive member 25C is exposed from the top surface of the terminal holder 21*j*. To be more specific, as shown in FIG. 16 and of FIG. 18A, the conductive members 25C have the conductive first plates 26 that are attached to the connector housing 21-2 on both outsides of the connection terminal rows 22*a* and 22*b* in the row direction of the connection terminals, and the conductive second plates 27*c* extending between the connection terminal rows 22*a* and 22*b* in the row direction of the connection terminals, and the first plate 26 and the second plate 27*c* are joined with the joint plate 28*c*. As shown in FIG. 18B, in the electric connector 20C, the second plate 27*c* constituting the conductive member 25C is attached to the terminal holder 21*j* at the middle portion in the row width direction of the connection terminal rows 22*a* and 22*b*, so as to be exposed outside.

The electric connector 20C according to the present embodiment is the same as the electric connector 20A according to the first embodiment in that the conductive members 25C have the conductive first plates 26 attached to the connector housing 21-2 on both outsides of the connection terminal rows 22*a* and 22*b* in the row direction of the connection terminals, and the conductive second plates 27*c* that are provided in the connector housing 21-2 and extend between the connection terminal rows 22*a* and 22*b* in the row direction of the connection terminals, and the first plate 26 and the second plate 27*c* are connected with the joint plate 28*c*. Therefore, when the conductive members 25C are used as power terminals or the like, the same effects as those in the first embodiment can be obtained.

More specifically, in the electric connector 20C according to the present embodiment, the second plate 27*c* of the conductive member 25C is composed of a plate member having a plate surface 27*c*1 that is perpendicular to the protrusion-depression engagement direction with the counterpart electric connector 30A. According to this configuration, in the electric connector 20C of the present embodiment, when the conductive members 25C are used as terminals, the conductive members 25C have increased volumes as the terminals due to the second plates 27*c*, so that it is possible to suppress heat generation and stabilize electric connection.

In the electric connector 20C according to the present embodiment, it is possible to increase a strength against a force in an orthogonal direction to the plate surfaces 27*c*1 of the second plates 27*c* of the conductive members 25C, in other words, with respect to the protrusion-depression engagement direction. Therefore, it can be expected that the electric connector 20C has a heat generation inhibiting effect and an electric connection stabilizing effect due to the extension of the second plates 27*c*, while ensuring the strength of the conductive members 25C as terminals. In this case, with such a configuration of the present embodiment in which the bent portions 27*c*2 are formed at tip end portions of the second plates 27*c*, causing the bent portions 27*c*2 to bite into the terminal holder 21*j* allows fixing the conductive member 25C more firmly.

In the electric connector 20C according to the present embodiment, the conductive members 25C can be operated as power terminals or the like in a pattern shown in, for example, FIGS. 12A and 12B. The electric connector 20C according to the present embodiment may have, for example, a modification example in which the two conductive members 25C on both ends are coupled with one second plate 27*c*, as in the case of the modification example of the first embodiment (see FIG. 13). In this case, for example, the conductive member 25C can be operated as one signal line or the like in a pattern shown in FIG. 15. Needless to say, each of the embodiments described later can also have a modification example (first plates 26 are coupled with one second plate 27*c*) in the same manner.

Third Embodiment

Figure 19:
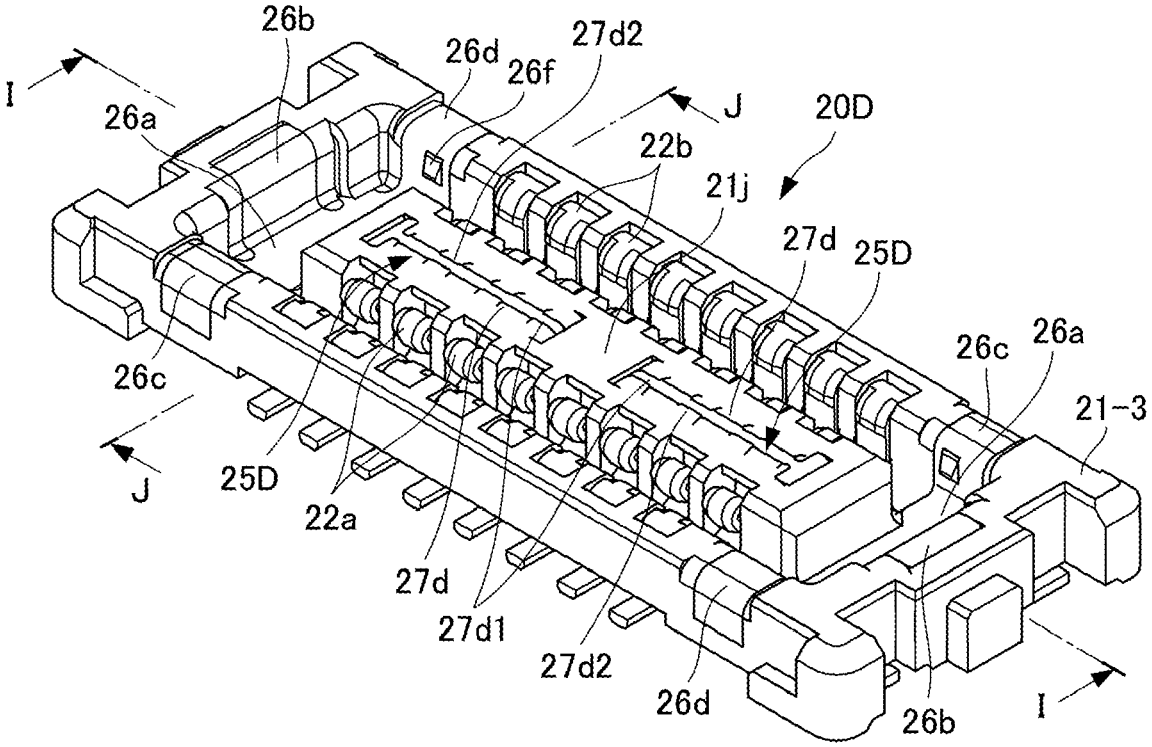
FIG. 19 is an exterior perspective view of an electric connector (socket) according to a third embodiment of the present invention.
Figure 20A:
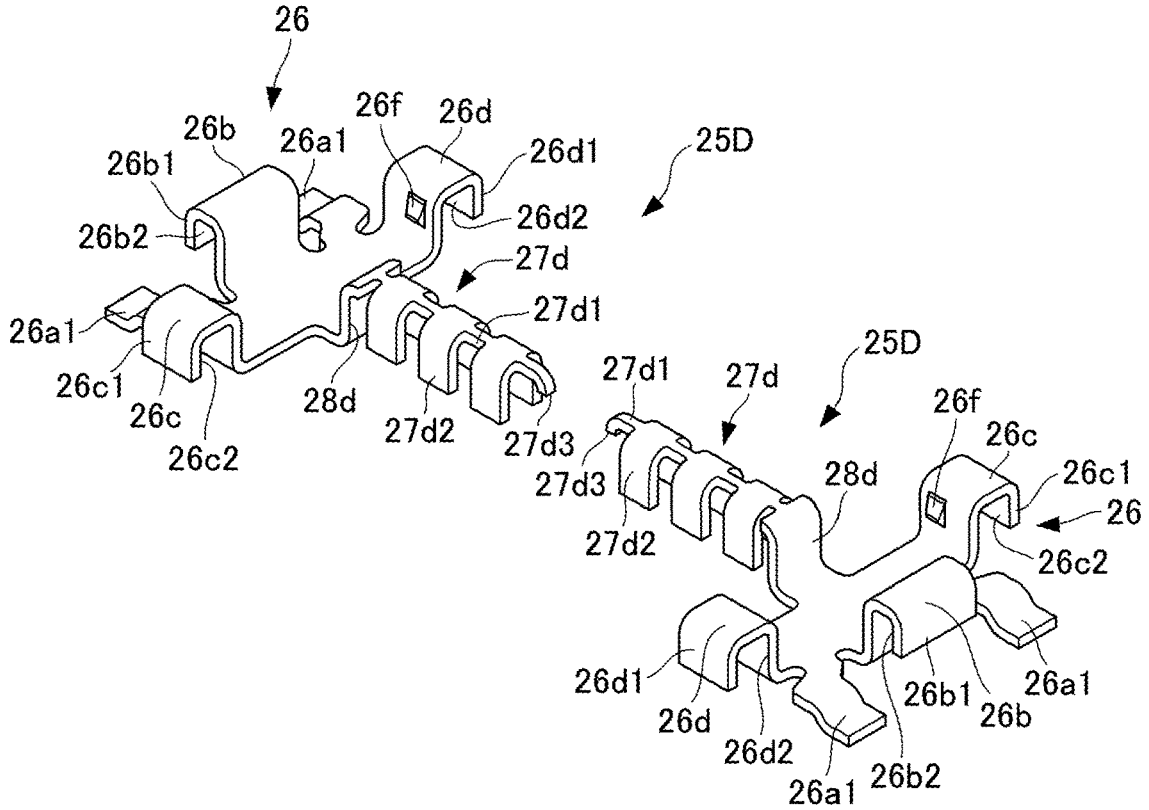
FIG. 20A is a perspective view of conductive members attached to a connector housing of the electric connector (socket) according to the third embodiment of the present invention, showing its exterior on a top side.
Figure 20B:
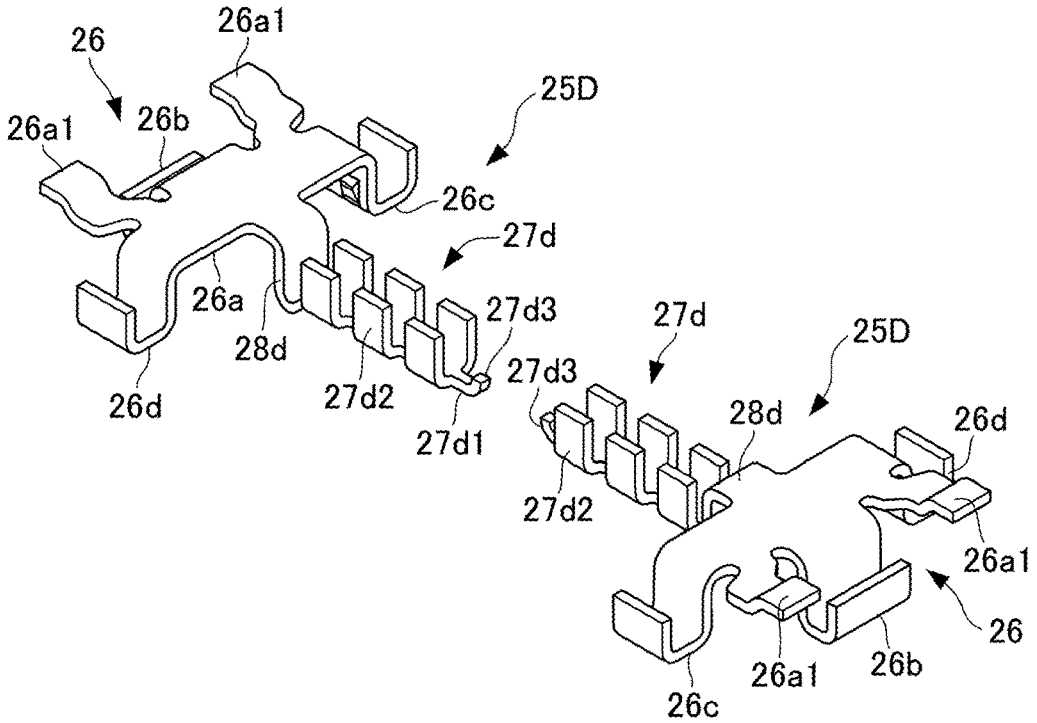
FIG. 20B is a perspective view of conductive members attached to the connector housing of the electric connector (socket) according to the third embodiment of the present invention, showing its exterior on a bottom side.
Figure 21A:
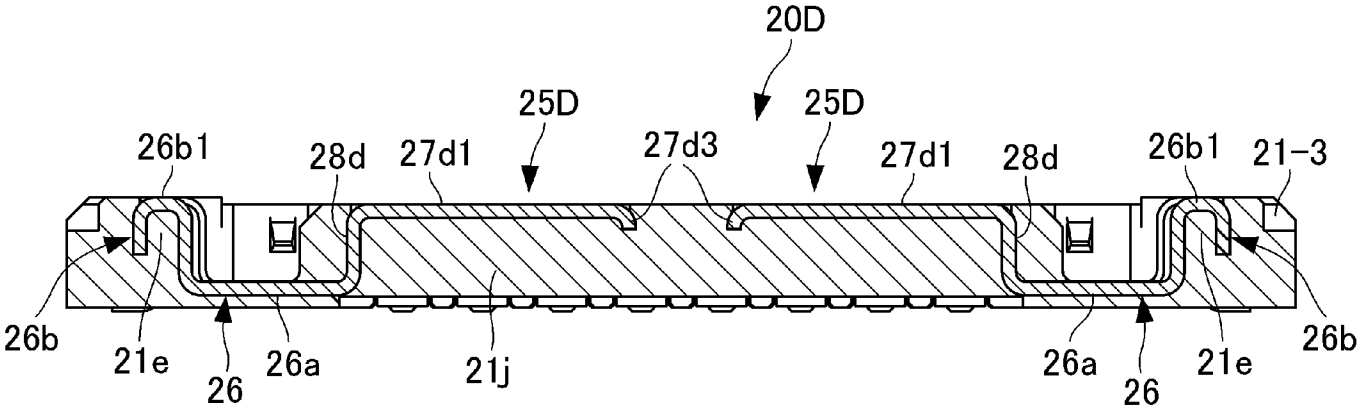
FIG. 21A is a longitudinal cross-sectional view of the connector housing of the electric connector (socket) according to the third embodiment of the present invention.
Figure 21B:
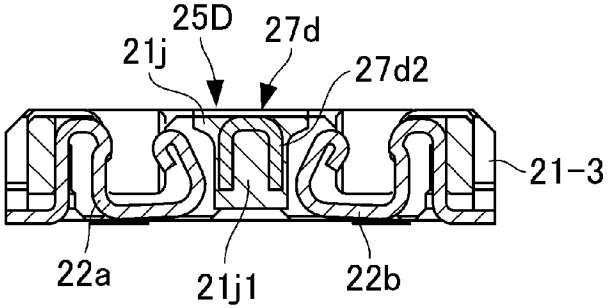
FIG. 21B is a transverse cross-sectional view of a longitudinal middle portion of the socket.

FIG. 19 is an exterior perspective view of an electric connector 20D according to a third embodiment of the present invention. FIGS. 20A and 20B include perspective views of conductive members 25D attached to a connector housing 21-3 of the electric connector 20D, and more specifically, FIG. 20A shows an exterior of its top side, and FIG. 20B shows an exterior of its bottom side. FIG. 21A is a longitudinal cross-sectional view of the connector housing 21-3 of the electric connector 20D according to the present embodiment in the longitudinal direction (cross-sectional view taken along line I-I of FIG. 19), and FIG. 21B is a transverse cross-sectional view of a longitudinal middle portion of the connector housing 21-3 (cross-sectional view taken along line J-J of FIG. 19).

In the electric connector 20D according to the present embodiment, the conductive members 25D having a configuration shown in FIGS. 20A and 20B are attached to the connector housing 21-3. In the conductive member 25D, the first plate 26 has the same configuration as that of the conductive member 25A according to the first embodiment, and the configuration of a second plate 27*d* and a joint plate 28*d* is different from that of the conductive member 25A.

As shown in FIGS. 20A and 20B, in the conductive member 25D, the joint plate 28*d* is composed of a plate member that is erected by a predetermined height from an end side of the plate surface 26*a* of the first plate 26 in a vertical direction (Z direction of FIG. 1). The second plate 27*d* has an extending portion 27*d*1 that is joined to a top end portion of the joint plate 28*d* and is bent at right angles and extends to the side of the other end of the first plate 26, a plurality of bent plate members 27*d*2 that are attached to the extending portion 27*d*1 at predetermined distance intervals in its longitudinal direction, and a bent portion 27*d*3 that is formed at the other end of the extending portion 27*d*1 and bent downward. As described above, in the conductive member 25D, the second plate 27*d* is configured such that the bent plate members 27*d*2 are provided on the extending portion 27*d*1, having the bent portion 27*d*3 at its one end, at predetermined intervals along the row direction of the connection terminal rows 22*a* and 22*b*, and each of the bent plate members 27*d*2 is bent in the row width direction of the connection terminal rows 22*a* and 22*b* so as to have an opening.

In the electric connector 20D according to the present embodiment, the two conductive members 25D having the aforementioned configuration are attached to the connector housing 21-3, in a state such that, for example as shown in FIG. 19, a part (extending portion 27*d*1 and the bent plate members 27*d*2) of the second plate 27*d* of each conductive member 25D is exposed from the top surface of the terminal holder 21*j*. To be more specific, as shown in FIG. 19 and FIG. 21A, the conductive members 25D have the conductive first plates 26 that are attached to the connector housing 21-3 on both outsides of the connection terminal rows 22*a* and 22*b* in the row direction of the connection terminals, and the conductive second plates 27*d* extending between the connection terminal rows 22*a* and 22*b* in the row direction of the connection terminals, and the first plate 26 and the second plate 27*d* are joined with the joint plate 28*d*. As shown in FIG. 21B, in the electric connector 20D, the second plate 27*d* constituting the conductive member 25D is attached to the terminal holder 21*j* such that the bent plate members 27*d*2 are situated at the middle portion in the row width direction of the connection terminal rows 22*a* and 22*b* and exposed outside. The second plate 27*d* is configured such that the bent plate members 27*d*2 are engaged with an engagement protruding portion 21*j*1, which is provided in the terminal holder 21*j* in conformity with the openings.

The electric connector 20D according to the present embodiment is the same as the electric connector 20A according to the first embodiment in that the conductive members 25D have the conductive first plates 26 attached to the connector housing 21-3 on both outsides of the connection terminal rows 22*a* and 22*b* in the row direction of the connection terminals, and the conductive second plates 27*d* that are provided in the connector housing 21-3 and extend between the connection terminal rows 22*a* and 22*b* in the row direction of the connection terminals, and the first plate 26 and the second plate 27*d* are joined with the joint plate 28*d*. Therefore, when the conductive members 25D are used as power terminals or the like, the same effects as the first embodiment can be obtained.

More specifically, in the electric connector 20D according to the present embodiment, the conductive members 25D are configured such that the second plates 27*d* are provided along the row direction of the connection terminal rows 22*a* and 22*b* at predetermined intervals, and each of the second plates 27*d* has the bent plate members 27*d*2 that are bent to both sides of the row width direction of the connection terminal rows 22*a* and 22*b* so as to have the openings to be engaged with the engagement protruding portion 21*j*1 of the terminal holder 21*j*. According to this configuration, in the electric connector 20D of the present embodiment, when the conductive members 25D are used as terminals, the conductive members 25D have increased volumes as the terminals due to the bent plate members 27*d*2 provided in the conductive members 25D, so that it is possible to suppress heat generation and stabilize electric connection. Engaging the openings of the bent plate members 27*d*2 with the engagement protruding portion 21j1 of the terminal holder 21j, causing the bent portions 27c2 at the tip end portions of the second plates 27c to bite into the terminal holder 21j, and the like allow fixing the conductive members 25D more firmly.

In the electric connector 20D according to the present embodiment, the conductive members 25D can also be operated as power terminals or the like in a pattern shown in, for example, FIGS. 12A and 12B. In the electric connector 20D according to the present embodiment, by a modification in which the two conductive members 25D on both ends are coupled with a second plate 27d, as in the case of the modification example of the first embodiment (see FIG. 13), the conductive member 25D can also be operated as one signal line or the like in, for example, a pattern shown in FIG. 15.

Fourth Embodiment

Figure 22:
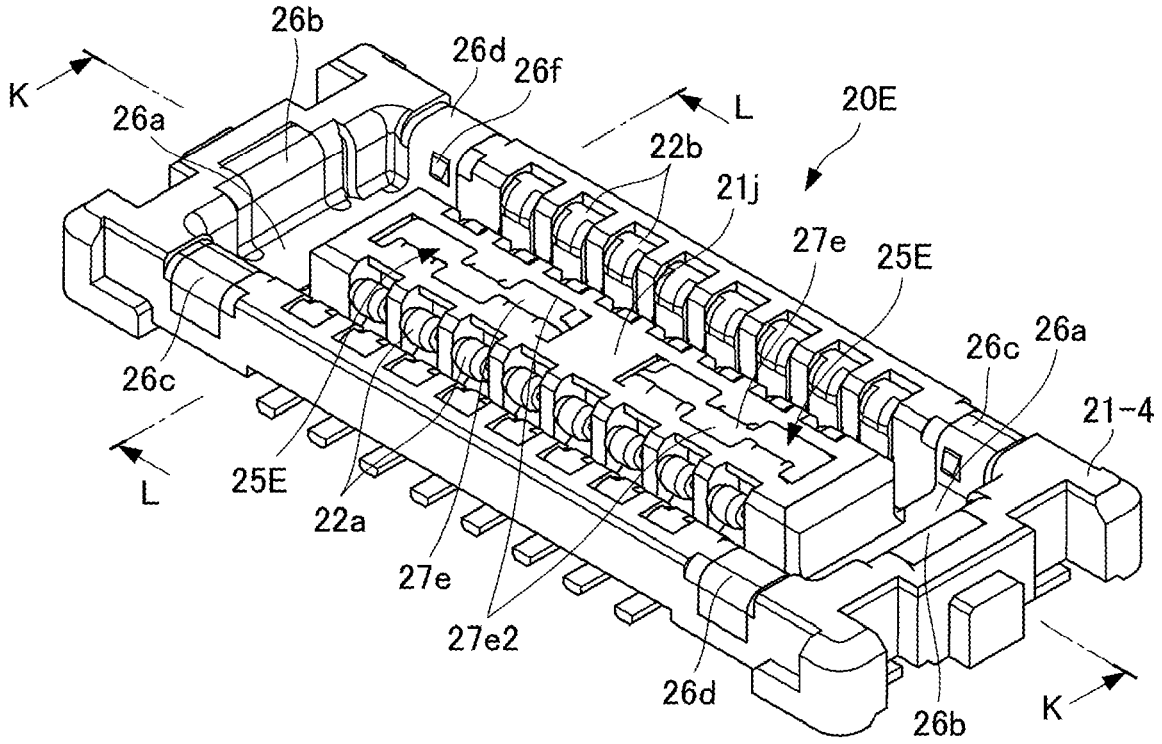
FIG. 22 is an exterior perspective view of an electric connector (socket) according to a fourth embodiment of the present invention.
Figure 23A:
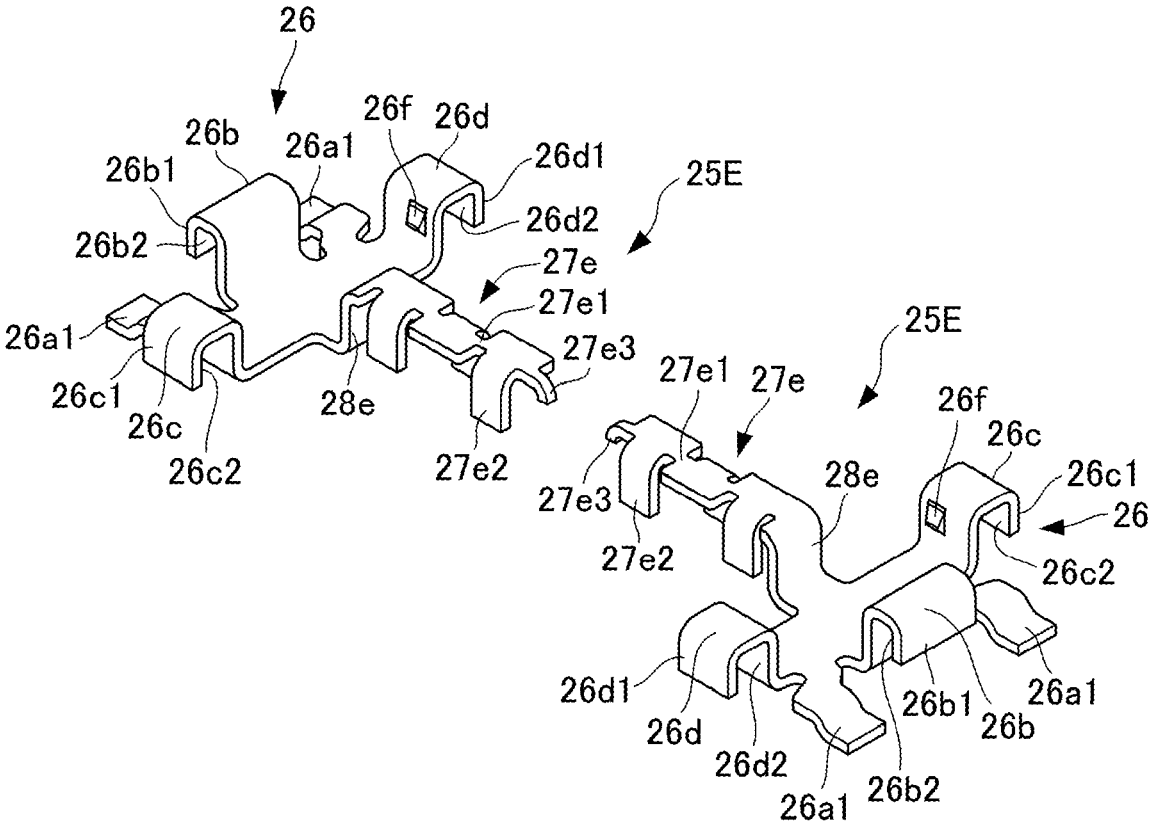
FIG. 23A is a perspective view of conductive members attached to a connector housing of the electric connector (socket) according to the fourth embodiment of the present invention, showing its exterior on a top side.
Figure 23B:
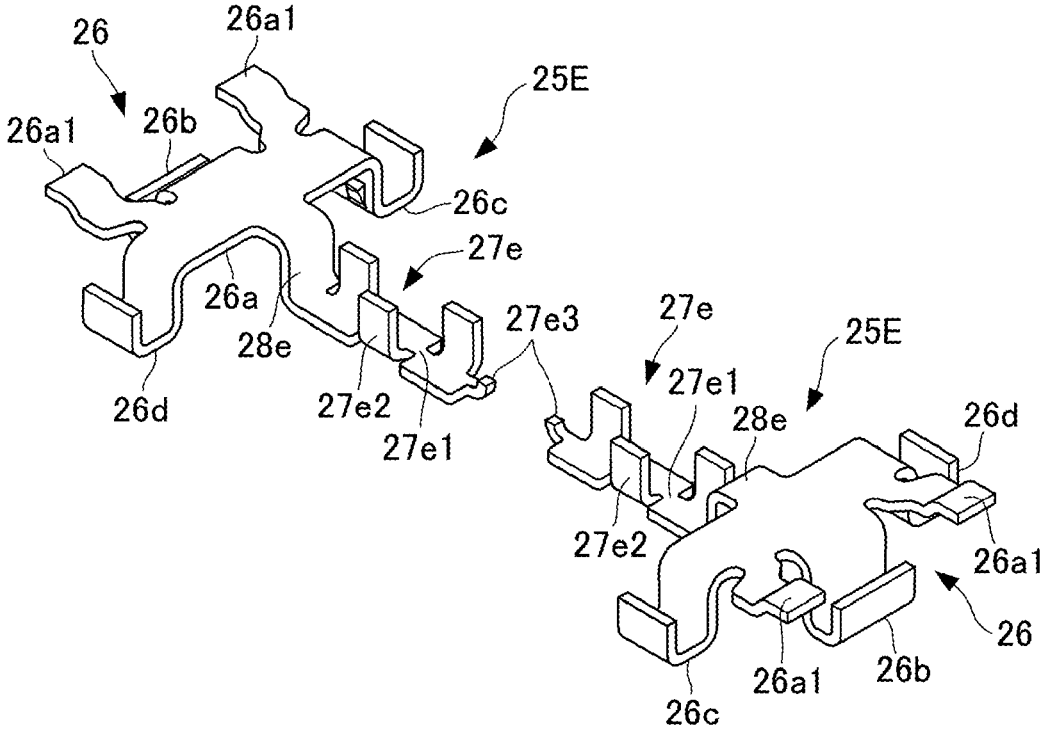
FIG. 23B is a perspective view of conductive members attached to the connector housing of the electric connector (socket) according to the fourth embodiment of the present invention, showing its exterior on a bottom side.
Figure 24A:
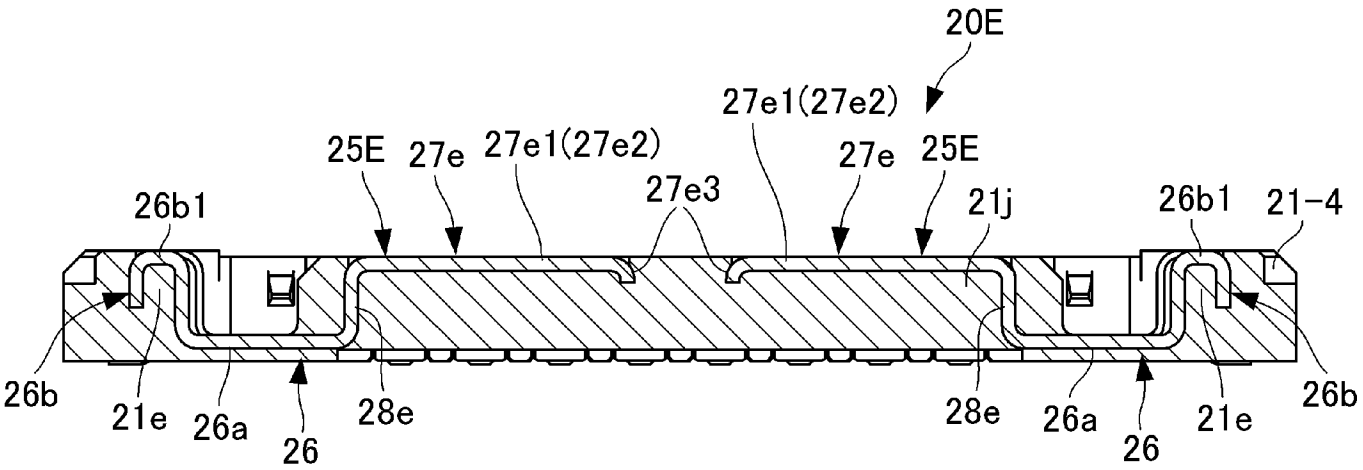
FIG. 24A is a longitudinal cross-sectional view of the connector housing of the electric connector (socket) according to the fourth embodiment of the present invention.
Figure 24B:
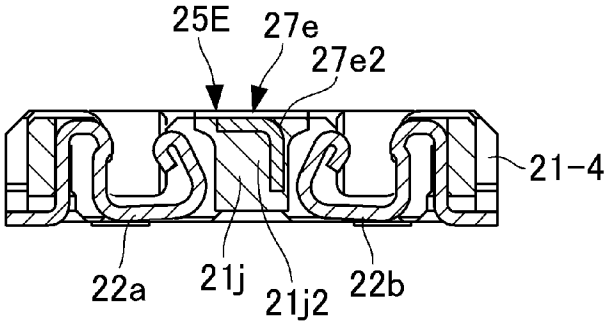
FIG. 24B is a transverse cross-sectional view of a longitudinal middle portion of the socket.

FIG. 22 is an exterior perspective view of an electric connector 20E according to a fourth embodiment of the present invention. FIGS. 23A and 23B include perspective views of conductive members 25E attached to a connector housing 21-4 of the electric connector 20E, and more specifically, FIG. 23A shows an exterior of its top side, and FIG. 23B shows an exterior of its bottom side. FIG. 24A is a longitudinal cross-sectional view of the connector housing 21-4 of the electric connector 20E according to the present embodiment in the longitudinal direction (cross-sectional view taken along line K-K of FIG. 22), and FIG. 24B is a transverse cross-sectional view of a longitudinal middle portion of the connector housing 21-4 (cross-sectional view taken along line L-L of FIG. 22).

In the electric connector 20E according to the present embodiment, the conductive members 25E having configuration shown in FIGS. 23A and 23B are attached to the connector housing 21-4. In the conductive member 25E, the first plate 26 has the same configuration as that of the conductive member 25A according to the first embodiment, and the configuration of a second plate 27e and a joint plate 28e is different from that of the conductive member 25A.

As shown in FIGS. 23A and 23B, in the conductive member 25E, the joint plate 28e is composed of a plate member that is erected by a predetermined height from an end side of the plate surface 26a of the first plate 26 in a vertical direction (Z direction of FIG. 1). The second plate 27e has an extending portion 27e1 that is joined to a top end portion of the joint plate 28e and is bent at right angles and extends to the side of the other end of the first plate 26, a plurality of bent plate members 27e2 that are attached to the extending portion 27e1 at predetermined distance intervals in its longitudinal direction, and a bent portion 27e3 that is formed at the other end of the extending portion 27e1 and bent downward. Although the bent plate members 27d2 of the conductive member 25D (see FIGS. 20A and 20B) according to the third embodiment are each in a bent shape on both sides of the row width direction of the connection terminal rows 22a and 22b so as to have the openings, the bent plate members 27e2 of the conductive member 25E according to the present embodiment are bent on one side (right side or left side) of the row width direction of the connection terminal rows 22a and 22b in an alternate manner.

In the electric connector 20E according to the present embodiment, the conductive members 25E having the aforementioned configuration are attached to the connector housing 21-4, in a state such that, for example as shown in FIG. 22, a part (extending portion 27e1 and the bent plate members 27e2) of the second plate 27e of each conductive member 25E is exposed from the top surface of the terminal holder 21j. To be more specific, as shown in FIG. 22 and FIG. 24A, the conductive members 25E have the conductive first plates 26 that are attached to the connector housing 21-4 on both outsides of the connection terminal rows 22a and 22b in the row direction of the connection terminals, and the conductive second plates 27e that are provided in the connector housing 21-4 so as to extend between the connection terminal rows 22a and 22b in the row direction of the connection terminals. The first plate 26 and the second plate 27e are joined with the joint plate 28e. As shown in FIG. 24B, in the electric connector 20E, the second plate 27e constituting the conductive member 25E is attached to the terminal holder 21j such that the bent plate members 27e2 are situated at the right or left of the middle portion in the row width direction of the connection terminal rows 22a and 22b and a top surface thereof is exposed outside. The second plate 27e is configured such that bent surfaces of the bent plate members 27e2 are engaged with an engagement portion 21j2 provided in the terminal holder 21j.

The electric connector 20E according to the present embodiment is the same as the electric connector 20A according to the first embodiment in that the conductive members 25E have the conductive first plates 26 attached to the connector housing 21-4 on both outsides of the connection terminal rows 22a and 22b in the row direction of the connection terminals, and the conductive second plates 27e that are provided in the connector housing 21-4 and extend between the connection terminal rows 22a and 22b in the row direction of the connection terminals, and the first plate 26 and the second plate 27e are joined with the joint plate 28e. Therefore, when the conductive members 25E are used as power terminals or the like, the same effects as the first embodiment can be obtained.

More specifically, in the electric connector 20E according to the present embodiment, the conductive members 25E are configured such that the second plates 27e are provided along the row direction of the connection terminal rows 22a and 22b at predetermined intervals, and each of the second plates 27e has the bent plate members 27e2 that are bent alternately to one side of the row width direction of the connection terminal rows 22a and 22b so as to form the surface that is engaged with the engagement portion 21j2 of the terminal holder 21j. According to this configuration, in the electric connector 20E of the present embodiment, when the conductive members 25E are used as terminals, the conductive members 25E have increased volumes as the terminals due to the bent plate members 27e2 provided in the conductive members 25E, so that it is possible to suppress heat generation and stabilize electric connection. Engaging the bent surfaces of the bent plate members 27e2 with the fitting portion 21j2 of the terminal holder 21j, causing the bent portions 27e3 at the tip end portions of the second plates 27e to bite into the terminal holder 21j, and the like allow fixing the conductive members 25E more firmly.

In the electric connector 20E according to the present embodiment, the conductive members 25E can also be operated as power terminals or the like in a pattern shown in, for example, FIGS. 12A and 12B. By a modification in which the two conductive members 25E on both ends are coupled with a second plate 27e, as in the case of the modification example of the first embodiment (see FIGS. 12A and 12B), the conductive members 25E according to the present embodiment can also be operated as one signal line or the like in, for example, a pattern shown in FIG. 15.

Fifth Embodiment

Figure 25:
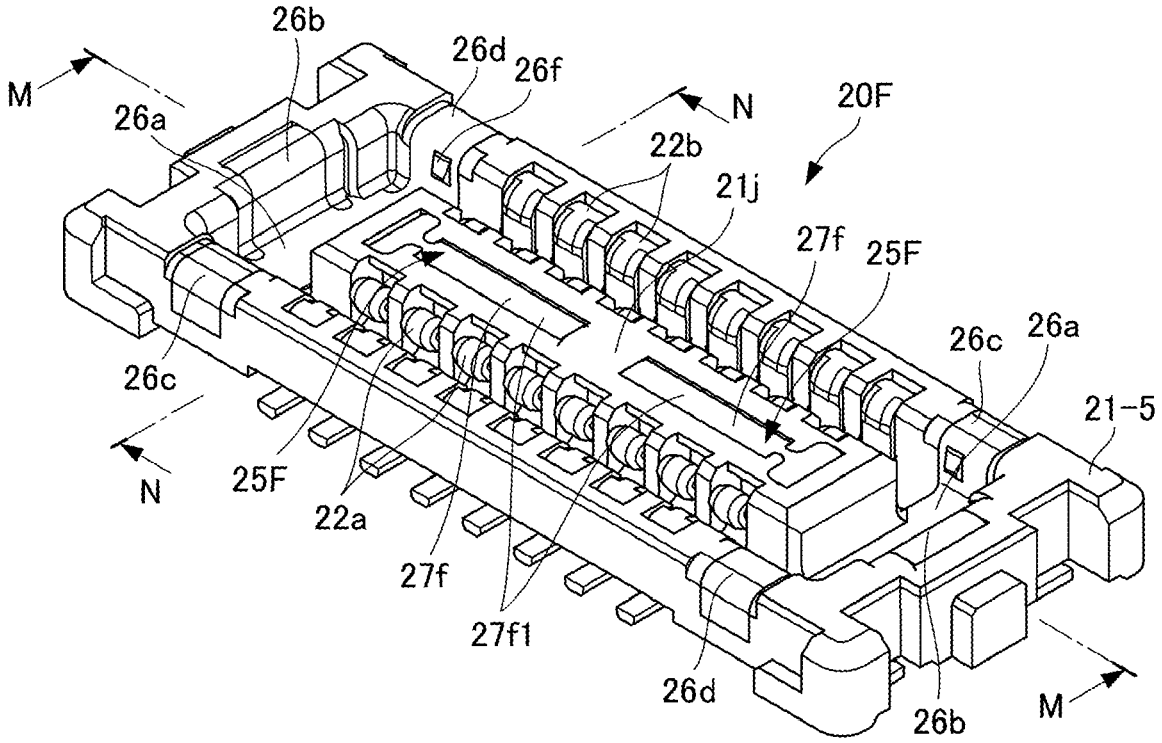
FIG. 25 is an exterior perspective view of an electric connector (socket) according to a fifth embodiment of the present invention.
Figure 26A:
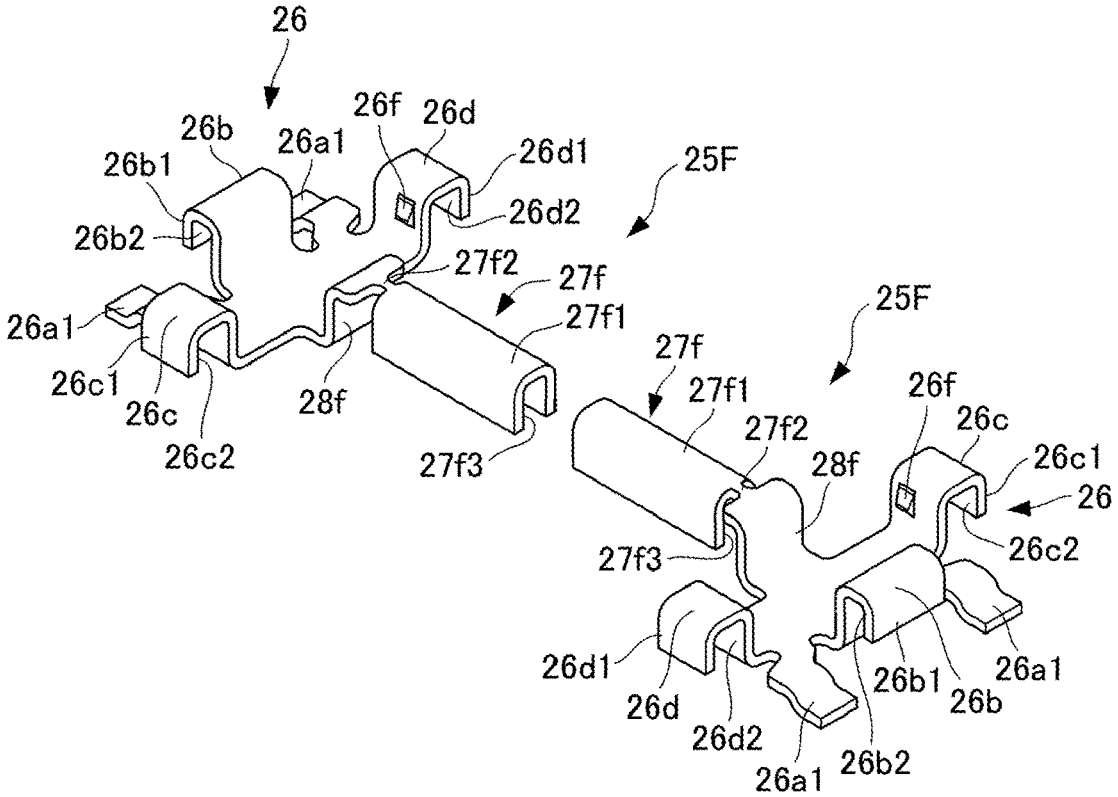
FIG. 26A is a perspective view of conductive members attached to a connector housing of the electric connector (socket) according to the fifth embodiment of the present invention, showing its exterior on a top side.
Figure 26B:
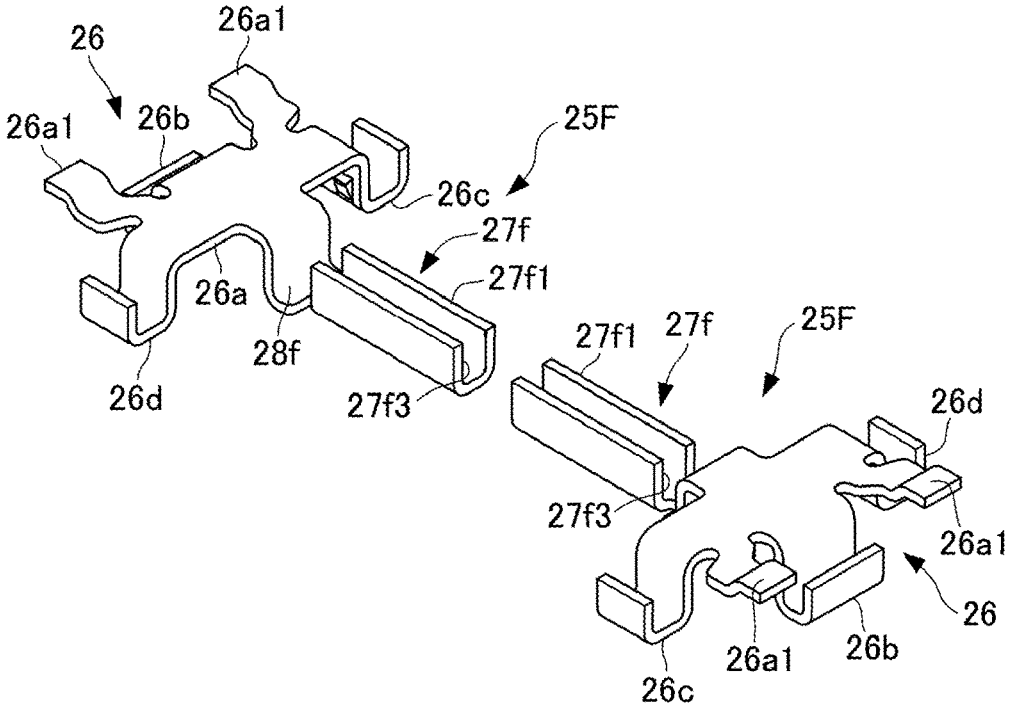
FIG. 26B is a perspective view of conductive members attached to the connector housing of the electric connector (socket) according to the fifth embodiment of the present invention, showing its exterior on a bottom side.
Figure 27A:
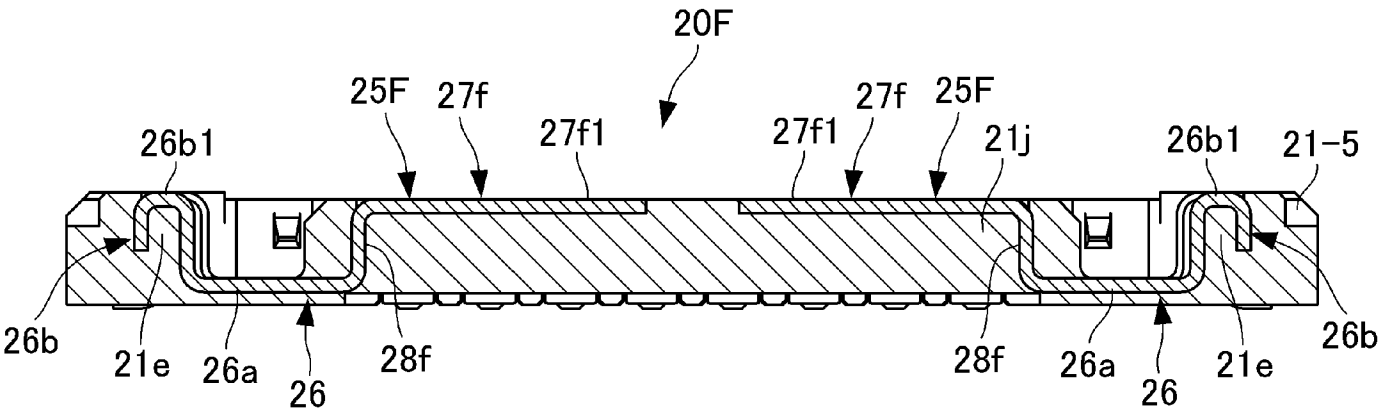
FIG. 27A is a longitudinal cross-sectional view of the connector housing of the electric connector (socket) according to the fifth embodiment of the present invention.
Figure 27B:
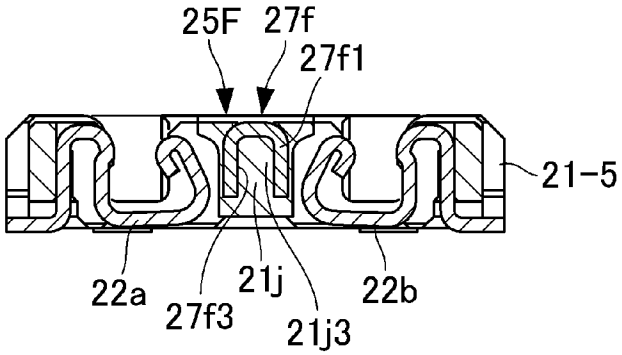
FIG. 27B is a transverse cross-sectional view of a longitudinal middle portion of the socket.

FIG. 25 is an exterior perspective view of an electric connector 20F according to a fifth embodiment of the present invention. FIGS. 26A and 26B include perspective views of conductive members 25F attached to a connector housing 21-5 of the electric connector 20F, and more specifically, FIG. 26A shows an exterior of its top side, and FIG. 26B shows an exterior of its bottom side. FIG. 27A is a longitudinal cross-sectional view of the connector housing 21-5 of the electric connector 20F according to the present embodiment in the longitudinal direction (cross-sectional view taken along line M-M of FIG. 25), and FIG. 27B is a transverse cross-sectional view of a longitudinal middle portion of the connector housing 21-5 (cross-sectional view taken along line N-N of FIG. 25).

In the electric connector 20F according to the present embodiment, the conductive members 25F having configuration shown in FIGS. 26A and 26B are attached to the connector housing 21-5. In the conductive member 25F, the first plate 26 has the same configuration as that of the conductive member 25A according to the first embodiment, and the configuration of a second plate 27*f* and a joint plate 28*f* is different from that of the conductive member 25A.

As shown in FIGS. 26A and 26B, in the conductive member 25F, the joint plate 28*f* is composed of a plate member that is erected by a predetermined height from an end side of the plate surface 26*a* of the first plate 26 in a vertical direction (Z direction of FIG. 1) and is bent at right angles in a horizontal direction at its top end. The second plate 27*f* has an extending portion 27*f*1 that extends to the side of the other end of the first plate 26 in the horizontal direction with respect to the end portion of the joint plate 28*f*, and a slim plate-shaped joint portion 27*f*2 that joins the extending portion 27*f*1 to the end portion of the joint plate 28*f*. In the second plate 27, the extending portion 27*f*1 is composed of a gutter member having a groove portion 27*f*3 along the row direction of the connection terminal rows 22*a* and 22*b*.

In the electric connector 20F according to the present embodiment, the two conductive members 25F having the aforementioned configuration are attached to the connector housing 21-5, in a state such that, for example as shown in FIG. 25, a part (extending portion 27*f*1) of the second plate 27*f* of each conductive members 25F is exposed from the top surface of the terminal holder 21*j*. To be more specific, as shown in FIG. 25 and FIG. 27A, the conductive members 25F have the conductive first plates 26 that are attached to the connector housing 21-5 on both outsides of the connection terminal rows 22*a* and 22*b* in the row direction of the connection terminals, and the conductive second plates 27*f* that extend between the connection terminal rows 22*a* and 22*b* in the row direction of the connection terminals. The first plate 26 and the second plate 27*f* are joined with the joint plate portion 28*f*. As shown in FIG. 27B, in the electric connector 20F, the second plate 27*f* constituting the conductive member 25F is attached to the terminal holder 21*j* such that the extending portion 27*f*1 is situated in the middle portion in the row width direction of the connection terminal rows 22*a* and 22*b* and a top surface thereof is exposed outside. The second plate 27*f* is configured such that the groove portion 27*f*3 of the gutter member constituting the extending portion 27*f*1 is engaged with an engagement protruding portion 21*j*3 provided in the terminal holder 21*j*.

The electric connector 20F according to the present embodiment is the same as the electric connector 20A according to the first embodiment in that the conductive members 25F have the conductive first plates 26 attached to the connector housing 21-5 on both outsides of the connection terminal rows 22*a* and 22*b* in the row direction of the connection terminals, and the conductive second plates 27*f* that are provided in the connector housing 21-5 and extend between the connection terminal rows 22*a* and 22*b* in the row direction of the connection terminals, and the first plate 26 and the second plate 27*f* are joined with the joint plate portion 28*f*. Therefore, when the conductive members 25F are used as power terminals or the like, the same effects as the first embodiment can be obtained.

More specifically, in the electric connector 20F according to the present embodiment, the conductive member 25F is configured such that the second plate 27 is composed of the gutter member having the groove portion 27*f*3 along the row direction of the connection terminal rows 22*a* and 22*b*. With such a configuration, in the electric connector 20F of the present embodiment, when the conductive members 25F are used as terminals, the conductive members 25F have increased volumes as the terminals due to the extending portions (gutter members) 27*f*1 provided in the conductive members 25F, so that it is possible to suppress heat generation and stabilize electric connection. Engaging the engagement protruding portion 21*j*3 of the terminal holder 21*j* with the groove portions 27*f*3 of the gutter members allows fixing the conductive members 25F more firmly.

In the electric connector 20F according to the present embodiment, the conductive members 25F can also be operated as power terminals or the like in a pattern shown in, for example, FIGS. 12A and 12B. By a modification in which the two conductive members 25F on both ends are coupled with one second plate 27*f*, as in the case of the modification example of the first embodiment (see FIG. 13), the conductive members 25F according to the present embodiment can also be operated as one signal line or the like in, for example, a pattern shown in FIG. 15.

Note that, the second to fifth embodiments describe cases in which the top surfaces of the second plates 27*c*, 27*d*, 27*e*, and 27*f* are exposed on the side of the top surface of the terminal holder 21*j*, but the second plates 27*c*, 27*d*, 27*e*, and 27*f* may be contained in the terminal holder 21*j* without being exposed.

As described above, the embodiments of the present invention can provide an electric connector that allows supply of a large current, while preventing heat generation at terminal portions, and that allows stabilization of electric connection, and an electric connector set. The present invention is applicable to general electric connectors each of which has a socket mounted on a circuit substrate and a plug protrusion-depression engaged with the socket.

REFERENCE SIGNS LIST

10 electric connector set
20A, 20B, 20C, 20D, 20E, 20F electric connector
21, 21-1, 21-2, 21-3, 21-4, 21-5 connector housing
21*a* depressed fitting portion
21*h*, 21*i* terminal holding portion
21*j* terminal holder
21*j*1, 21*j*3 engagement protruding portion
21*j*2 engagement portion
22*a*, 22*b* connection terminal row
24 reinforcing metal piece
25A, 25B, 25C, 25D, 25E, 25F conductive member
26 first plate
26*a* plate surface
26*a*1 external joint portion

27*a*, 27*b*, 27*c*, 27*d*, 27*e*, 27*f* second plate
27*a*1, 27*b*1, 27*c*1 plate surface
27*d*1, 27*e*1 extending portion
27*d*2, 27*e*1 bent plate member
27*f*1 extending portion
27*f*3 groove portion
28, 28*c*, 28*d*, 28*e*, 28*f* joint plate
30A electric connector
31 connector housing
31*a* protruding fitting portion
31*c* middle depressed portion

The invention claimed is:

1. An electric connector comprising:

a connector housing having a depressed fitting portion, the connector housing being able to be protrusion-depression engaged with a connector housing of a counterpart connector having a protruding fitting portion in an opposed direction;

a plurality of connection terminal rows arranged approximately in a same plane in the connector housing; and a conductive member having conductive first plates attached to the connector housing on both outsides of the connection terminal rows in a row direction of the connection terminal rows, wherein the connector housing has a terminal holder that is provided in a protruding manner in the depressed fitting portion at a position opposite a middle depressed portion of the protruding fitting portion, and holds one end of each connection terminal in the connection terminal rows in a row width direction, the conductive member has conductive second plates that extend respectively from an end portion of each of the first plates on a side of the terminal holder to an inside of the terminal holder in the row direction of the connection terminal rows, the conductive second plates extend to a position between the connection terminal rows in the terminal holder, and conductive joint plates respectively intersect each of the first plates and a plate surface of each of the second plates.

2. The electric connector according to claim 1, wherein the conductive member is configured such that the second plates are composed of a plate member having a plate surface parallel with a protrusion-depression engagement direction.

3. The electric connector according to claim 1, wherein the conductive member is configured such that the second plates are composed of a plate member having a plate surface perpendicular to a protrusion-depression engagement direction.

4. The electric connector according to claim 1, wherein the conductive member is configured such that the second plates are composed of bent plate members that are provided at predetermined intervals along the row direction, and each of the bent plate members is bent at both sides in the row width direction so as to have an opening engaged with an engagement protruding portion of the terminal holder.

5. The electric connector according to claim 1, wherein the conductive member is configured such that the second plates are composed of bent plate members that are provided at predetermined intervals along the row direction, and the bent plate members are bent alternately to one side of the row width direction so as to form a surface that is engaged with an engagement portion of the terminal holder.

6. An electric connector comprising:

a connector housing having a depressed fitting portion, the connector housing being able to be protrusion-depression engaged with a connector housing of a counterpart connector having a protruding fitting portion in an opposed direction;

a plurality of connection terminal rows arranged approximately in a same plane in the connector housing; and a conductive member having conductive first plates attached to the connector housing on both outsides of the connection terminal rows in a row direction of the connection terminals, wherein the connector housing has a terminal holder that is provided in a protruding manner in the depressed fitting portion at a position opposite a middle depressed portion of the protruding fitting portion, and holds one ends of the connection terminals in a row width direction, the conductive member has a second plate that extends from an end portion of the first plates on a side of the terminal holder to an inside of the terminal holder in the row direction of the connection terminals, and the conductive member is configured such that the second plate is composed of a gutter member having a groove portion along the row direction.

7. The electric connector according to claim 2, wherein the conductive member is configured such that a part of the second plates are exposed on a side of a top surface of the terminal holder.

8. The electric connector according to claim 1, wherein the conductive member is configured such that a first one of the second plates extending from a first one of the first plates, and a second of the second plates extending from a second one of the first plates are conductively coupled to each other.

9. An electric connector set comprising the electric connector according to claim 1, and the counterpart connector.

* * * * *